US006336294B1

(12) United States Patent
Kowalczyk et al.

(10) Patent No.: US 6,336,294 B1
(45) Date of Patent: Jan. 8, 2002

(54) AUTOMATIC DOOR ASSEMBLY AND DOOR OPERATOR THEREFOR

(75) Inventors: Thomas M. Kowalczyk, Farmington; Brian D. Hass, Meriden, both of CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/497,730

(22) Filed: Feb. 4, 2000

Related U.S. Application Data

(60) Provisional application No. 60/118,791, filed on Feb. 4, 1999.

(51) Int. Cl.[7] ..... E05F 15/08

(52) U.S. Cl. ..... 49/339; 49/340

(58) Field of Search ..... 49/139, 140, 324, 49/327, 333, 334, 340, 341, 344, 339; 185/40 R

(56) References Cited

U.S. PATENT DOCUMENTS

| | | | | |
|---|---|---|---|---|
| 1,927,559 A | | 9/1933 | Talen | |
| 1,986,639 A | | 1/1935 | Konn | |
| 3,087,720 A | | 4/1963 | Catlett | |
| 3,237,932 A | | 3/1966 | Catlett | |
| 3,422,704 A | | 1/1969 | Catlett | |
| 3,425,161 A | | 2/1969 | Catlett et al. | |
| 3,457,674 A | | 7/1969 | Catlett et al. | |
| 3,605,339 A | | 9/1971 | Catlett et al. | |
| 3,625,328 A | | 12/1971 | Carli | |
| 3,668,737 A | | 6/1972 | Tillmann | |
| 3,675,370 A | | 7/1972 | Catlett | |
| 3,689,720 A | * | 9/1972 | Patel | 200/153 C |
| 3,760,455 A | | 9/1973 | Berry et al. | |
| 3,834,081 A | | 9/1974 | Catlett | |
| 4,045,914 A | | 9/1977 | Catlett | |
| 4,134,231 A | | 1/1979 | Daugirdas et al. | |
| 4,220,051 A | * | 9/1980 | Catlett | 74/89.15 |
| 4,231,192 A | | 11/1980 | Daugiras et al. | |
| 4,333,270 A | | 6/1982 | Catlett | |
| 4,501,090 A | * | 2/1985 | Yoshida et al. | 49/264 |
| 4,596,310 A | * | 6/1986 | Hatakeyama et al. | 185/40 R |
| 4,599,824 A | | 7/1986 | Mitsuhashi et al. | |
| 4,727,679 A | | 3/1988 | Kornbrekke et al. | |
| 4,744,125 A | | 5/1988 | Scheck et al. | |
| 4,760,895 A | * | 8/1988 | Wichham | 185/40 R |
| 4,785,493 A | | 11/1988 | Tillmann et al. | |
| 5,193,647 A | | 3/1993 | O'Brien, II | |
| 5,221,239 A | * | 6/1993 | Catlett | 475/342 |
| 5,386,855 A | * | 2/1995 | Bunzl et al. | 185/40 R |
| 5,386,885 A | | 2/1995 | Bunzl et al. | |
| 5,680,674 A | | 10/1997 | Guthrie | |
| 6,223,469 B1 | * | 5/2001 | Moll | 49/341 |

FOREIGN PATENT DOCUMENTS

| | | |
|---|---|---|
| DE | 32 02 930 A1 | 8/1983 |
| EP | 544 254 A1 | 6/1993 |
| FR | 2707695 A1 | 6/1993 |
| GB | 1270355 | 4/1972 |

* cited by examiner

*Primary Examiner*—Curtis A. Cohen
(74) *Attorney, Agent, or Firm*—Pillsbury Winthrop LLP

(57) ABSTRACT

The present application discloses automatic door assemblies and swing operators therefor. One aspect of the disclosure provides a swing door operator that has spring return breakout and from motor driven opening. Another aspect of the disclosure provides a swing door operator that is non-handed with spring return from either direction. Another aspect of the disclosure provides a swing door operator in which spring force is transmitted to the operator output member via a cam structure.

105 Claims, 11 Drawing Sheets

AUTOMATIC DOOR ASSEMBLY AND DOOR OPERATOR THEREFOR

The present application claims priority to U.S. Provisional Application of Kowalczyk et al., Serial No. 60/118,791, filed Feb. 4, 1999, the entirety of which is hereby incorporated into the present application by reference in its entirety.

BACKGROUND AND SUMMARY OF THE VARIOUS ASPECTS OF THE INVENTION

Swing door operators are well-known in the automatic door assembly art for controlling the pivoting movements of pivoting or swing door panels between open and closed positions thereof. In most automatic door assemblies, the door panel is moved under power by the door operator in a normal motor driven door opening direction in response to an input device thereof detecting the presence of a person or object adjacent to the door assembly. During this opening movement, energy is stored within a spring structure or the like and, after the door panel has stopped moving, the spring structure releases its energy to move the door panel back towards and into its closed position.

Most building codes require these automatic door assemblies to enable the door panel to be opened in a "breakout" manner under manual force or pushing to enable persons to exit the building in emergency situations. Depending on the installation of the operator, this breakout movement may be in the direction opposite the motor driven direction. In this situation, the door panel may not be spring returned from breakout back to its closed position because the spring arrangements inside many prior art operators are not capable of providing this spring returned movement. In most situations, the motor normally cannot be used to return the door because many building codes require that power to the motor be cutoff after breakout has occurred. As a result, the door panel remains open in its breakout condition until a manual force is applied to move the panel back into its closed position.

Another problem with most known swing door operators is their inability to function in a "non-handed" manner. In the door operator art, swing door operators are typically classified as right-handed or left-handed depending on the direction in which the output member thereof rotates. The term "non-handed" reflects the ability of the operator to be used to pivot a door in either direction. The reason most known door operators are only able to rotate their output members in one direction is a result of using rack and pinion arrangements. The rack and pinion arrangement only allows the motor to drive the rack in one direction to rotate the output member for door opening with a spring driving the rack in an opposite direction to counter-rotate the output member for door closing. Other types of door operators use a clock or torsion spring to provide spring driven movement. The problem with these operators is that the spring only functions to provide door movement in one direction. It is known to extend the output member in opposing axial directions from opposing sides of the operator housing so that either end of the output member can be connected to the door. The appropriate end of the output member is connected to the door based on the desired pivoting direction of the door. This arrangement, however, is problematic because of the potential for confusion during installation. Also, once this type of operator has been installed, there is no way to change the direction in which the door is opened by the motor without removing the entire operator and re-installing it in an inverted manner.

U.S. Pat. No. 5,221,239 to Catlett, the entirety of which is hereby incorporated into the present application by reference, discloses a swing door operator that is both non-handed and capable of providing spring return from breakout. In the embodiment of FIG. 12 thereof, the '239 patent discloses a rectilinearly movable rack gear 66 intermeshed with the output member or shaft 17 and a spring return module 77B with a spring 75 for driving the rack gear. Rotation of the shaft 17 in a clockwise direction as viewed in FIG. 12 drives the rack gear 66 to the right from its initial position corresponding to a door closed position, which in turn moves spring seat 83 to the right to compress the spring 75. After ceasing the clockwise rotation of the shaft 17, the spring 75 resiliently extends to drive the spring seat 83 and hence the rack gear 66 back to the left towards and into its initial position. Rotation of the shaft 17 in a counterclockwise direction drives the rack gear 66 from its initial position to the left, which moves the spring seat 95 to the left via operation rod 103 to compress the spring 75. After ceasing the counterclockwise rotation of the shaft 17, the spring 75 resiliently extends to drive the rack gear 66 back to the right towards and into it initial position. Thus, the door operator of FIG. 12 can be used to effect spring return from either direction of door opening movement. This enables the door operator to be non-handed simply by reversing the current polarity delivered to its DC motor and also enables the operator to provide spring return from breakout in either direction.

Although the door operator of the '239 patent provides the capability for non-handedness and spring return from breakout, the design thereof is complex and hence costly to manufacture and commercialize. In particular, the spring module requires a number of small components, such as the movable spring seats and the operating rods, that add to the total part number of the operator. These small parts are also difficult to assemble together in a precise manner and the number of parts also contributes to an increased time for assembly. Overall, the complexity of the construction of door operator in the '239 patent makes it undesirable because of the increased manufacturing costs.

Consequently, there exists a need in the art for a door operator with spring return from breakout that has a construction that is simpler and more cost-effective than the complex construction disclosed in the aforementioned '239 patent. Further, there also exists a need in the art for a non-handed door operator that also has a construction that is simpler and more cost-effective that the complex construction disclosed in the aforementioned '239 patent.

It is therefore an object of the present invention to meet the above-described needs. To achieve this object, one aspect of the invention provides a swing door operator for controlling pivoting movements of a door panel that pivots about a generally vertical door panel axis from a closed position in a power driven door opening direction and a manually driven breakout door opening direction opposite the motor driven direction. The operator comprises an operator output member rotatable about an output member axis and constructed and arranged to be operatively connected with the door panel such that rotation of the output member about the output member axis pivots the door panel about the door panel axis thereof. This operative connection may either be direct or be via an indirect linkage, gearing, or the like. The operator also comprises a motor constructed and arranged to rotate the output member about the output member axis in a first rotational direction such that, when the output member is operatively connected to the door panel, the output member pivots the door panel in the power driven door opening direction from the closed position thereof. The motor may be reversible and thus capable of rotating the output member in a second rotational direction opposite the first rotational direction, which enables the door operator to be non-handed. However, this aspect of the invention is not limited to such an arrangement.

The operator also comprises a driving member connected to the output member such that applying force to the driving member rotates the output member about the output member axis. The driver member comprises an offset member spaced radially from the output member axis such that (a) the offset member moves generally circumferentially with respect to the output member axis in a first circumferential direction as the output member rotates about the output member axis in the first rotational direction and (b) the offset member moves generally circumferentially with respect to the output member axis in a second circumferential direction opposite the first circumferential direction as the output member rotates about the output member axis in a second rotational direction opposite the first rotational direction. A door return compression spring structure is positioned in force applying relation with respect to the offset member via a camming relation or by a mechanical linkage or the like such that operation of the motor to rotate the output member in the first rotational direction thereof and pivot the door in the power driven door opening direction moves the offset member in the first circumferential direction thereof so as to stress the compression spring structure. This stressing may be done either by extending the spring structure or compressing the spring structure. The compression spring structure is constructed and arranged to thereafter apply a first spring return force to the offset member that tends to move the offset member in the second circumferential direction thereof so as to rotate the output member in the second rotational direction thereof and pivot the door panel operatively connected thereto opposite the power driven door opening direction towards and into the closed position. This provides for spring return from motor driven movement of the door panel.

The door return compression spring structure is also positioned in the force applying relation with respect to the offset member such that manual pivoting movement of the door panel from the closed position thereof in the manually driven breakout door opening direction thereof rotates the output member in the second rotational direction thereof and moves the offset member in the second circumferential direction thereof so as to stress the compression spring structure. The compression spring structure is constructed and arranged to thereafter apply a second spring return force to the offset member that tends to rotate the output member in the first rotational direction thereof and pivot the door panel operatively connected thereto opposite the breakout door opening direction towards and into the closed position. This provides for spring return from breakout.

A related aspect of the present invention provides an automatic door assembly comprising a frame assembly, a door panel that pivots about a generally vertical door panel axis from a closed position in the motor driven door opening direction and the manually driven breakout door opening direction, the door operator as described above, an input device operable to transmit a door opening signal in response to detecting a presence of an object adjacent the door assembly, and a controller communicated with the input device. The controller is operable to receive the door opening signal from the input device and to responsively control operation of the door operator's motor so as to cause the door operator to pivot the door panel in the motor driven door opening direction thereof. The input device may be of any type known in the art, such as an infrared motion detector, a pressure-sensitive mat adjacent the door panel, a microwave motion detector, or any other suitable system the presence of an object adjacent the door assembly. The controller may also be of an construction known in the art for controlling operation of the door operator.

Another aspect of the invention also provides a swing door operator for controlling pivoting movements of a door panel that is to be pivoted about a generally vertical door panel axis from a closed position in a power driven door opening direction and from the closed position in a manually driven breakout door opening direction opposite the power driven door opening direction. The swing door operator according to this aspect of the invention comprises an operator output member rotatable about an output member axis. The operator output member is constructed and arranged to be operatively connected with the door panel such that rotation of the output member about the output member axis pivots the door panel about the door panel axis thereof. A motor is constructed and arranged to rotate the output member about the output member axis in a first rotating direction such that, when the output member is operatively connected to the door panel, the operator output member pivots the door panel in the power driven door opening direction from the closed position thereof. A driving member is connected to the output member such that applying force to the driving member rotates the output member about the output member axis. A cam structure is engaged with the driving cam member in a camming relationship.

A door return compression spring structure is positioned in force applying relation with respect to the cam structure such that operation of the motor to rotate the output member in the first rotational direction thereof and pivot the door in the power driven door opening direction causes the driving member to cam the cam structure so as to move the cam structure to stress the compression spring structure. The compression spring structure is constructed and arranged to thereafter apply a first spring return force to the cam structure that tends to cause the cam structure to cam the driving member so as to rotate the output member in the second rotational direction thereof and pivot the door panel operatively connected thereto opposite the power driven door opening direction towards and into the closed position. The door return compression spring structure is positioned in the force applying relation with respect to the cam structure such that manual pivoting movement of the door panel from the closed position thereof in the manually driven breakout door opening direction thereof rotates the output member in the second rotational direction thereof and causes the driving member to cam the cam structure so as to move the cam structure to stress the compression spring structure. The compression spring structure is constructed and arranged to thereafter apply a second spring return force to the cam structure that tends to cause the cam structure to cam the driving member so as to rotate the output member in the first rotational direction thereof and pivot the door panel operatively connected thereto opposite the breakout door opening direction towards and into the closed position. This provides spring return from breakout via a camming relationship to eliminate the potential for wearing down of the gear teeth in the spring return path of the aforementioned '239 patent.

A related aspect of the present invention provides an automatic door assembly comprising a frame assembly, a door panel that pivots about a generally vertical door panel axis from a closed position in the motor driven door opening direction and the manually driven breakout door opening direction, the door operator as described above, an input device operable to transmit a door opening signal in response to detecting a presence of an object adjacent the door assembly, and a controller communicated with the input device. The controller is operable to receive the door opening signal from the input device and to responsively control operation of the door operator's motor so as to cause the door operator to pivot the door panel in the motor driven door opening direction thereof. The input device may be of any type known in the art, such as an infrared motion detector, a pressure-sensitive mat adjacent the door panel, a microwave motion detector, or any other suitable system the presence of an object adjacent the door assembly. The controller may also be of an construction known in the art for controlling operation of the door operator.

Yet another aspect of the present invention provides a non-handed swing door operator for controlling pivoting movements of a door panel that pivots about a generally vertical door axis from a closed position to an open position. The swing door operator comprises an operator output member rotatable in first and second operator rotational directions about an operator output member axis. The operator output member is constructed and arranged to be operatively connected with the door panel such that rotation of the output member pivots the door about the door panel axis thereof. A reversible motor is coupled to the operator output member. The motor is constructed and arranged to rotate the operator output member in a selected one of the first and second operator rotational directions. The rotational direction may be selected either by activating a reversing switch carried by the motor or a controller which is connected to the motor when the operator is assembled into an automatic door assembly. Alternatively, the rotational direction may be selected by the manner in which the motor is connected to its power supply. For example, with an electric motor, the polarity of the current flowing to the motor can be reversed simply by reversing the wires supplying power to the terminals of the motor. With a fluid driven or hydraulic motor, the direction of fluid flowing to the motor can be reversed simply by reversing the conduits supplying fluid through the inlet and outlet ports of the motor.

A driving member is connected to the output member such that applying force to the driving member rotates the output member about the output member axis. The driving member comprises an offset member spaced radially from the output member axis such that (a) the offset member moves generally circumferentially with respect to the output member axis in a first circumferential direction as the output member rotates about the output member axis in the first operator rotational direction and (b) the offset member moves generally circumferentially with respect to the output member axis in a second circumferential direction opposite the first circumferential direction as the output member rotates about the output member axis in the second operator rotational direction.

A door return compression spring structure is positioned in force applying relation with respect to the offset member such that operation of the motor to rotate output member in the first operator rotational direction thereof moves the offset member in the first circumferential direction thereof so as to stress the spring structure. The spring structure is constructed and arranged to thereafter apply a first spring return force to the offset member that tends to move the offset member in the second circumferential direction thereof to rotate the operator output member in the second operator rotational direction thereof. Likewise, the door return compression spring structure is positioned in the force applying relation with respect to the offset member such that operation of the motor to rotate the operator output member in the second operator rotational direction thereof moves the offset member in the second circumferential direction thereof so as to stress the spring structure. The spring structure is constructed and arranged to thereafter apply a second spring return force to the offset member that tends to move the offset member in the first circumferential direction thereof to rotate the operator output member in the first operator rotational direction thereof. As a result, the spring structure provides a spring return regardless of which rotational direction the motor rotates the output shaft and thus provides the operator with its desirable non-handed capability with spring return in each operational direction.

A still further aspect of the invention also provides a non-handed swing door operator for controlling pivoting movements of a door panel that pivots about a generally vertical door axis from a closed position to an open position. The swing door operator comprises an operator output member rotatable in first and second operator rotational directions about an operator output member axis. The operator output member is constructed and arranged to be operatively connected with the door panel such that rotation of the output member pivots the door panel about the door panel axis thereof. A reversible motor is coupled to the operator output member. The motor isg constructed and arranged to rotate the operator output member in a selected one of the first and second operator rotational directions. A driving member is connected to the output member such that applying force to the driving member rotates the output member about the output member axis. A cam structure is engaged with the driving member in a camming relationship.

A door return compression spring structure is positioned in force applying relation with respect to the cam structure such that operation of the motor to rotate the output member in the first operator rotational direction thereof causes the driving member to cam the cam structure so as to move the cam structure to stress the spring structure. The spring structure is constructed and arranged to thereafter apply a first spring return force to the cam structure that tends to cause the cam structure to cam the driver member so as to rotate the operator output member in the second operator rotational direction thereof. The door return compression spring structure is positioned in the force applying relation with respect to the cam structure such that operation of the motor to rotate the output member in the second operator rotational direction thereof causes the driving member to cam the cam structure so as to move the cam structure to stress the spring structure. The spring structure is constructed and arranged to thereafter apply a second spring return force to the cam structure that tends to cause the cam structure to cam the driving member so as to rotate the operator output member in the first operator rotational direction thereof.

The advantage of a non-handed door operator according to either one of the above-aspects of the invention is that it both provides the capability for the operator to be installed in a door assembly designed for either left or right handed swinging and it can be used in a door assembly wherein motor driven door opening occurs in both directions from the closed direction thereof A further aspect of the invention provides a swing door operator for controlling pivoting movements of a door panel that is to be pivoted about a generally vertical door panel axis from a closed position to an open position. The swing door operator comprises an operator output member rotatable about an output member axis. The operator output member is constructed and arranged to be operatively connected with the door panel such that rotation of the output member about the output member axis pivots the door panel about the door panel axis thereof. A motor is coupled to the operator output member. The motor is constructed and arranged to rotate the output member about the output member axis such that, when the output member is operatively connected to the door panel, the operator output member pivots the door panel about the door panel axis thereof. A driving member is connected to the output member such that applying force to the driving member rotates the output member about the output member axis. A cam structure has a cam surface engaged with the driving member in a camming relationship.

A door return compression spring structure is positioned in force applying relation with respect to the cam structure. The cam structure and the driving member are constructed and arranged such that operation of the motor to rotate the output member in a first rotational direction thereof and pivot the door in a first door panel pivoting direction about the door panel axis thereof causes the driving member to cam the cam surface so as to move the cam structure to stress the compression spring structure. The compression spring structure is constructed and arranged to thereafter apply a spring force to the cam structure that tends to cause the cam surface to cam the driving member so as to rotate the output member in a second rotational direction opposite the first rotational direction thereof and pivot the door panel operatively connected thereto in a second door pivoting direction opposite the first door pivoting direction about the door panel axis thereof.

A related aspect of the present invention provides an automatic door assembly comprising a frame assembly, a door panel that pivots about a generally vertical door panel axis from a closed position in the motor driven door opening direction and the manually driven breakout door opening direction, the door operator as described above, an input device operable to transmit a door opening signal in response to detecting a presence of an object adjacent the door assembly, and a controller communicated with the input device. The controller is operable to receive the door opening signal from the input device and to responsively control operation of the door operator's motor so as to cause the door operator to pivot the door panel in the motor driven door opening direction thereof.

Other objects, features, and advantages of the present invention will become apparent from the following detailed description, the accompanying drawings, and the appended claims.

BRIEF DESCRIPTION OF THE DRAWINGS

FIG. 15(*b*) is an elevated profile view of the operator of FIG. 15(*a*); and FIG. 15(*c*) is a bottom view of the operator of FIG. 15(*a*).

DETAILED DESCRIPTION OF THE PREFERRED EMBODIMENT OF THE INVENTION

Figure 1:
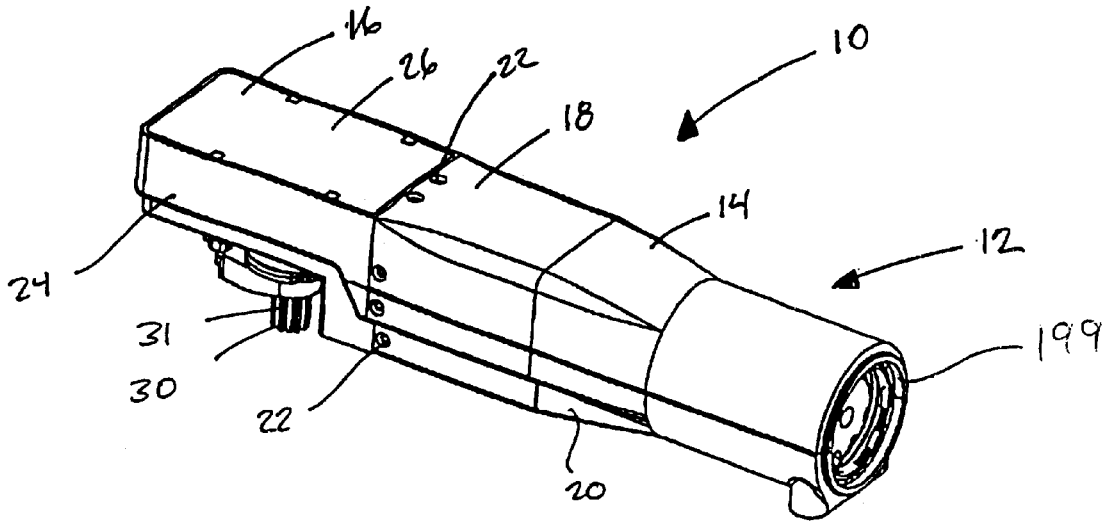
FIG. 1 is a perspective view of a swing door operator constructed in accordance with the principles of the present invention, the perspective being taken from above the operator.
Figure 2:
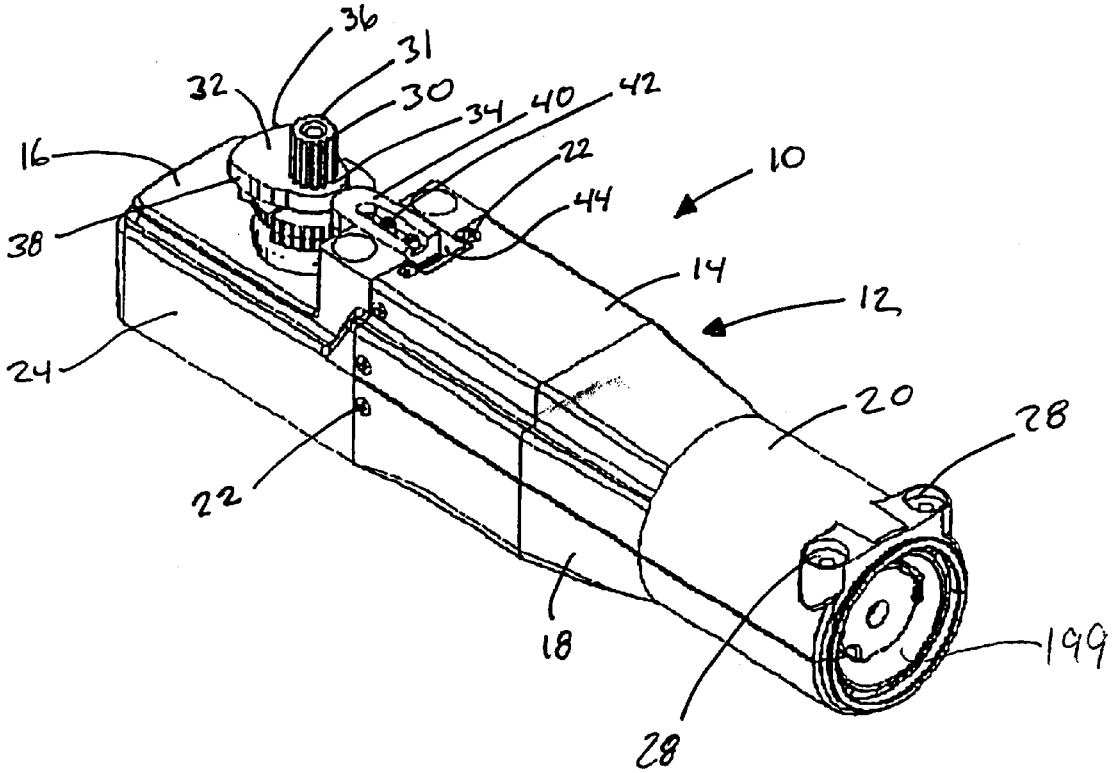
FIG. 2 is a perspective view of the operator of FIG. 1, the perspective being taken from below the operator.

FIG. 1 shows a perspective view of a swing door operator, generally indicated at 10, constructed in accordance with the principles of the present invention, the perspective being taken from above the operator. FIG. 2 shows a perspective view taken from below the operator 10. The operator 10 has a stamped, metal outer casing, or housing generally indicated at 12, comprising a motor/reduction transmission housing portion, generally indicated at 14, and an output drive assembly housing portion, generally indicated at 16.

Figure 14:
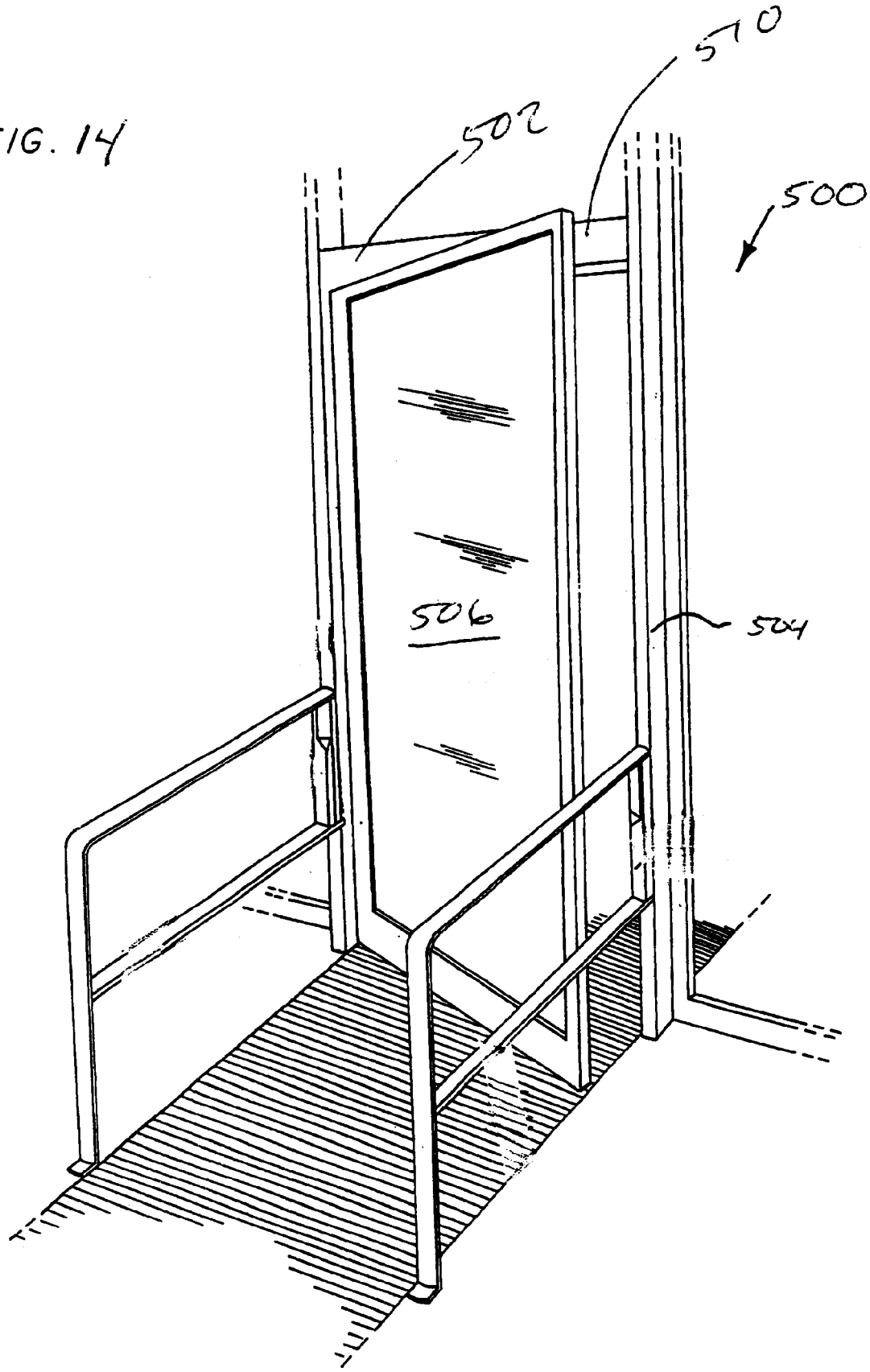
FIG. 14 is a perspective view of a swing door assembly in which the operator of FIG. 1 may be used.

The motor/reduction transmission housing portion 14 has upper and lower housing halves 18, 20, respectively, that are each secured together to a rearward end portion of the output drive assembly housing portion 16 by a plurality of threaded fasteners 22, such as conventional bolts or screws. The construction of the upper and lower housing halves 18, 20 and the manner in which they are secured to the output drive assembly housing portion 16 can be best appreciated from FIG. 4. The output drive assembly housing portion 16 comprises a lower housing shell 24 with an upwardly facing rectangular opening and a rectangular upper plate 26 that closes the opening of the lower shell 24. The shell 24 and plate 26 are also secured together by a plurality of fasteners 22. The construction of the upper plate 26 and the lower housing shell 24 can be best appreciated from FIGS. 5 and 6. A set of threaded bores 28 are provided on the casing 12 so that the operator 10 can be mounted in its operating position above a swinging door (not shown). The operator 10 may mounted directly above the door in its door jamb or in a laterally extending header provided on the frame 504 of the automatic door assembly 500 (see FIG. 14), but it may be offset and extend laterally away from the door, depending on space restrictions.

An operator output member 30 extends downwardly from the lower housing shell 24 of housing portion 16 and is rotatable about an operator output member axis. The output member 30 has an elongated pinion gear portion 31 that is constructed and arranged to be operatively connected directly to a swinging door panel 506 (shown in FIG. 14) that pivots back and forth in opening and closing directions about a generally vertically extending door panel axis. The connection between the door panel 506 and the output member 30 may be indirect via an intervening connector, such as an intervening gear or shaft or a linking arm; or it may be direct. To directly connect the operator to the swinging door panel 506, the output member 30 is inserted into a bore (not shown) having internal gear teeth formed coaxially with the door axis on the upper portion of the door panel 506. The teeth of the output member 30 engage the teeth formed inside the bore in a fixed intermeshed relationship so that rotation of the output member 30 pivots the door panel 506 about its axis and, conversely, pivoting the door panel 506 about it axis will rotate the output member 30. The end of the output member 30 may be configured differently to cooperate with door panels 506 having different types of bores for receiving the output member 30. For example, some doors may have an oval, non-toothed bore and thus it would be necessary to provide an output member with a corresponding oval shape.

Figure 4:
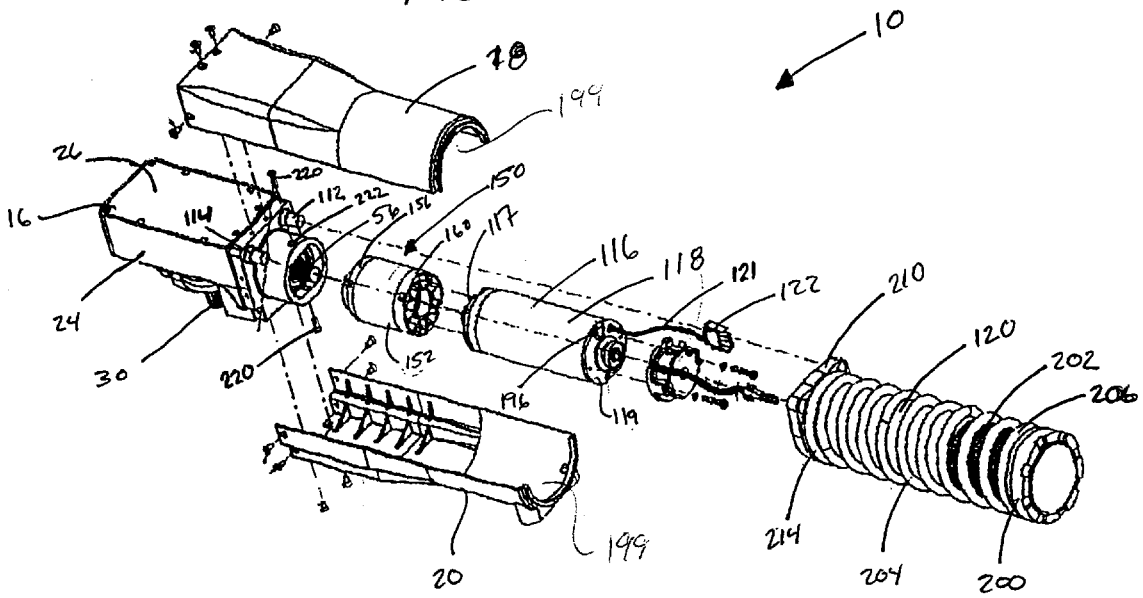
FIG. 4 is an exploded perspective view of the operator of FIG. 1 with the upper and lower halves of the motor/reduction gear transmission housing portion separated and the components therein disassembled, the perspective being taken from above the operator.
Figure 5:
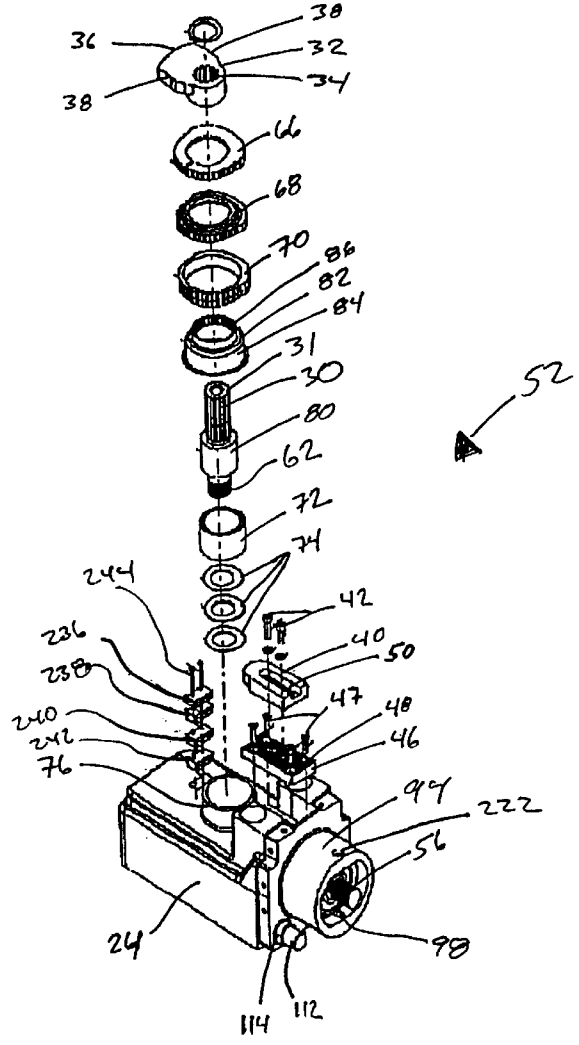
FIG. 5 is an exploded perspective view of the components that are associated with the underside of the output drive assembly housing portion, including components of the output drive assembly, the adjustable stop member, and the switch element modules, the perspective being taken from below the output drive assembly housing portion.

A rotating stop member 32 (referred to as an operator stop member) having an internally toothed bore 34 (the bore is best seen in FIG. 5) is mounted over the outer end of the output member 30 with the internal teeth of bore 34 fixedly intermeshed with the teeth on the exterior of a pinion gear or splined portion of the output member 30. The stop member 30 rotates along with the output member 30 and has an eccentric configuration that extends radially with respect to the axis of the output member 30. As best seen in FIG. 4, the stop member 32 has a rounded radially outer surface 36 and a pair of generally radially extending side surfaces 38 that taper inwardly towards one another away from the outer surface 36. The configuration of the stop member 32, although eccentric, is generally symmetrical with respect to a centerline taken radially to the output member axis between the side surfaces 38.

An adjustable stop member 40 is mounted on the underside of the lower housing half 20 of the output drive assembly housing portion 16 by a pair of fasteners 42. The housing portion 16 has a rectangular recessed space 44 in which the stop member 40 is mounted. As best seen in FIG. 5, a fixed toothed structure in the form of mounting plate 46 is mounted within the space 44 by a set of fasteners 47 in the form of screws. The mounting plate 46 has a toothed surface 48 with teeth arranged in a generally radial direction wit respect to the operator output axis and a pair of threaded bores for receiving the fasteners 42. The adjustable stop member 40 also has a toothed surface (not shown) with teeth arranged in a generally radial direction with respect to the operator output axis configured to intermesh or mate with the teeth on mounting plate 46 and a longitudinal slot 50 through which the fasteners 42 can be inserted. The adjustable stop member 40 is fixedly mounted by positioning it on the mounting plate 46 with the teeth of each intermeshed, then inserting the fasteners 42 through the slot 50 and into the threaded bores of the plate 46, and finally tightening the fasteners 42 to lock the stop member 40 to the plate 46 with the intermeshed teeth preventing relative movement therebetween. The stop member 40 is constructed and arranged to be moved through a range of adjusting positions in a direction that extends generally radially with respect to the output member axis by loosening the fasteners 42 sufficiently to allow the teeth to be disengaged from one another, moving the stop member 40 towards or away from the rotating stop member 32, and then re-tightening the fasteners 42 to lock the stop member 40 in its new position.

During operation of the operator 10, the rotating or operator stop member 30 rotates along with the output member 30 about the output member axis. This rotation occurs regardless of whether such rotation is motor driven, spring driven, or as a result of the door being manually pivoted about its axis during breakout. As the stop member 30 rotates, one of the side surfaces 38 thereof will abut against the adjustable stop member 40 to prevent further rotation of the output member 30 and hence further pivoting of the door panel 506. The amount of rotation permitted is determined or set by the positioning of the adjustable stop member 40 in its range of adjusting positions. The further radially inwardly the stop member 40 is moved with respect to the output member axis (i.e., the closer to the rotating stop member), the sooner the side surfaces 38 of the rotating stop member 30 will contact the stop member 40 during rotation, thus resulting in a more narrow pivot range for the door panel 506. Conversely, the further radially outwardly the stop member 40 is moved with respect to the output member axis, the later the side surfaces 38 of the rotating stop member 30 will contact the stop member 40 during rotation, thus resulting in a wider pivot range for the door 506. The symmetrical configuration of the rotating stop member 30, specifically the symmetry of the side surfaces 38, is preferred to provide the door panel 506 with the same pivot range regardless of which direction it pivots during opening. The pivot range is easily adjusted by loosening the fasteners 42 on the adjustable stop member and repositioning the adjustable stop member 42 to a desired location.

The rotating stop member 30 does not necessarily have to be symmetrical. For certain applications, it may be desired to have a wide pivot range in one opening direction and a narrower pivot range in the opposing opening direction. For such applications, a non-symmetrical stop member could be designed. To accommodate different pivot range specifications it is within the scope of the present invention to assemble the rotating stop member 32 in a modular fashion. In this modular fashion, a number of different rotating stop members would be provided and the operator 10 could be marked or otherwise coded as being designed for a specific application. Based on this coding, the appropriate stop member 32 is chosen for the desired application and assembled to the output member 30. For special applications, a custom-made stop member could be manufactured and assembled to the output member 30.

Figure 3:
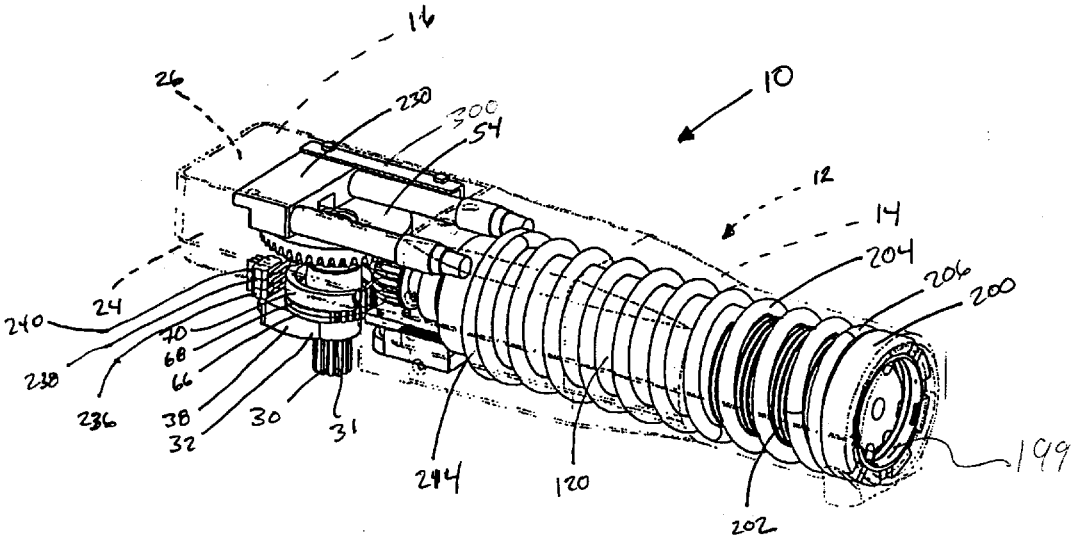
FIG. 3 is perspective view similar to FIG. 1, but with the casing of the operator being shown in phantom to illustrate the internal components of the operator.
Figure 6:
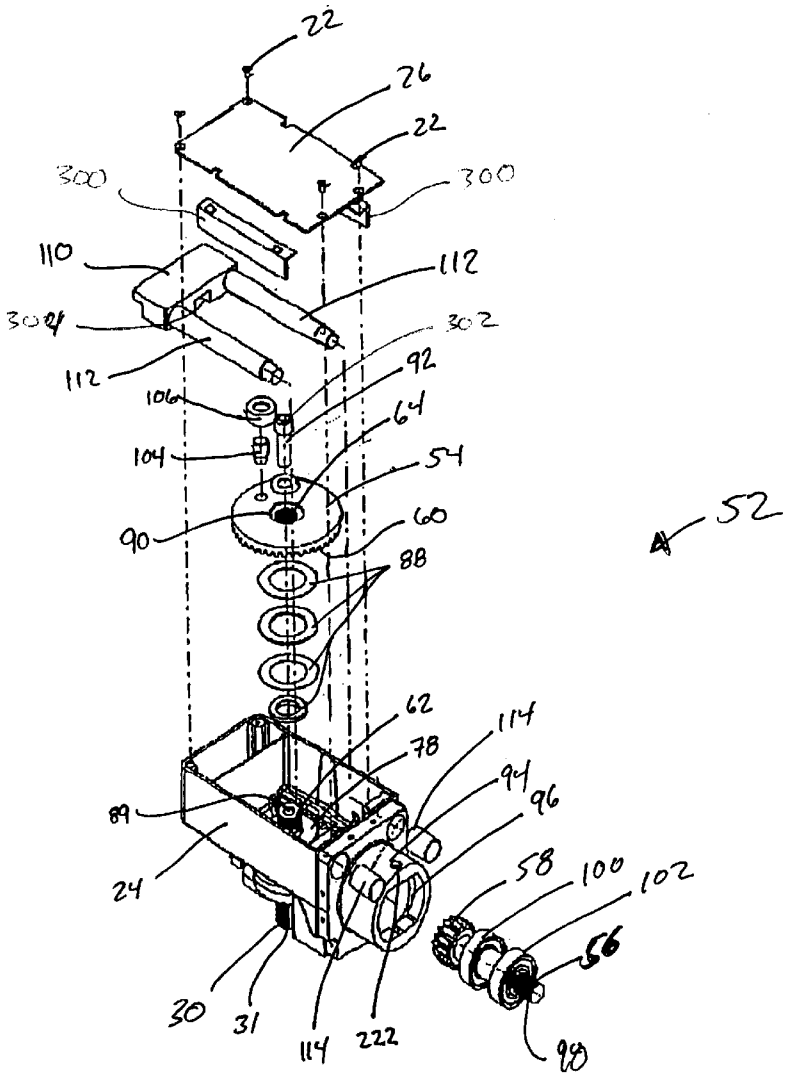
FIG. 6 is an exploded perspective view of the components that are associated with the interior of the output drive assembly housing portion, including components of the output drive assembly, and the camming structure, the perspective view being taken from above the output drive assembly housing portion with the upper cover plate removed for better illustration.

The output drive assembly 52 can be best seen in FIGS. 3, 5, and 6. The output drive assembly 52 comprises the output member 30, a drive member 54 rotatable about the output member axis, the rotating stop member 32, a drive assembly input member 56 rotatable about an axis that extends perpendicularly (i.e. radially) to the output member axis, and a rotating bevel gear 58 fixedly mounted to the input member 56 for rotation therewith. The drive member 54 has an associated set of gear teeth 60 formed on the lower side thereof and the bevel gear 58 has an associated set of gear teeth. These sets of gear teeth are engaged with one another intermeshed relation to couple the input and output members together. The elongated pinion gear portion 31 of the output member 30 extends downwardly along the output member axis and a connecting pinion gear portion 62 is formed on the opposing end of the output member 30. The drive member 54 has a central bore formed therethrough with an internal set of gear teeth 64. The connecting end portion 62 of the output member 30 is inserted into the central bore with the teeth 64 of the bore and the teeth of the connecting portion 62 fixedly intermeshed together. As a result of this connection, the rotation of the drive member 54 rotates the output member 30 and, conversely, rotation of the output member 30 rotates the drive member 54.

The drive assembly 52 also includes three contact members in the form of switch cams 66,68,70 that are mounted exteriorly of the outermost housing 12 for rotation along with the output member 30, a roller bearing 72, and a series of thrust bearings 74. The lower housing shell 24 has a cylindrical receiving portion 76 extending from the lower wall thereof. An opening (not shown) is formed through the lower wall of the lower housing shell 24 inside the receiving portion 76 coaxially with the output member axis to define a wall portion 78 that is continuous with the lower wall of the lower housing shell 24 and that extends radially inwardly from the wall of the cylindrical receiving portion 76. During assembly, the thrust bearings 74 are placed inside the receiving portion 76, the roller bearing 72 is abutted against the washers 78, and the output member 30 is then inserted through the bushing 72, the thrust bearings 74, and the opening in wall portion 78 with the connecting end portion 62 thereof extending into the interior of the lower housing shell 24. The interior diameter of the roller bearing 72 is substantially identical to the exterior diameter of a central smooth, non-geared portion 80 of the output member 30 to ensure that the output member does not move radially or "wobble" during rotation. Also, the thrust bearings 74 function to prevent frictional wear on the output member 30 and the wall portion 78 of the lower shell portion 24. The roller bearing 72 and thrust bearings 74 are optional, but are preferred to reduce wear and increase component longevity.

A generally cylindrical outer collar 82 having a wide diameter portion 84 and a narrow diameter portion 86 fits over the receiving portion 76 with the wide diameter portion 86 being slidingly received over the receiving portion 76. Switch cam 70 has a generally cylindrical bore that is force fit over the wide diameter portion of the outer collar 82 and switch cams 66 and 68 each have a generally cylindrical bore that is force fit over the narrow diameter portion 86. The collar 82 is keyed to the stop member 32 so that the switch cams 66, 68, 70 rotate together with the output member 30 and the stop member 32. A plurality of contact switches modules 236, 238, 240, and 242 each including a contact switch are mounted to the underside of the housing 12 adjacent the output member 30 and the switch cams 66, 68, 70. During such rotation of the output member 30 to affect movement of the door panel through the range of open positions thereof, the cams 66, 68, 70 are each moved through a corresponding range of contact member positions. Each switch cam 66, 68, 70 is constructed and arranged such that a contact surface thereof engages an associated contact switch which each are communicable to the door assembly controller (not shown) to transmit a contact signal to the controller indicating the that switch has been contacted or "tripped." This indicates to the controller the corresponding position of the door panel so that the controller can control operation of the motor using this information concerning door panel position. The elongated pinion gear portion 31 extends outwardly beyond the switch cams 66,68,70 and the stop member 30 attached thereto as described above.

The four switch modules 236, 238, 240, and 242 are removably mounted to the lower housing shell 24 adjacent the switch cams 66, 68, 70. Each switch module includes a conventional relay contact switch which is engaged by an associated one of the switch cams during rotation of the output member 30. The contact switches are connected to the controller by wires which are not shown in the Figures. The lower two switch modules 236, 238 adjacent the stop member 32 are engaged by switch cam 66 when the output member 30 rotates as a result of the door being opened in the "breakout" direction—i.e., pivot beyond fully closed opposite the direction in which the door usually opens. When the relay switches of the two lower contact switch modules 236, 238 are tripped by the switch cam 66, the controller will cut off power to the motor 116 to prevent operation thereof. Most building codes require such a feature to prevent persons from activating the motor while the door is pushed to a breakout position so that the door does not move towards the fully closed position. The contact relay of the third switch 240 adjacent the second lowers switch module 238 is engaged by switch cam 68 during rotation thereof. This switch is triggered by switch cam 68 when the door is approximately 10 degrees from fully closed and signals the controller to increase the resistance of the motor so that the last 10 degrees of closure occurs at a lower rate against the increased motor resistance. The top switch module 242 is an auxiliary switch module and may be used for a wide variety of purposes. The relay contact of module switch 242 is engaged by switch cam 66 during rotation of the output member 30. One exemplary use for such an auxiliary switch module 242 is to allow the controller to count the number of times the door has been opened or closed. Other various uses will be readily understood by those skilled in the art.

Each of the switch modules 236, 238, 240, 242 has a pair of apertures formed therethrough. The apertures of the modules are aligned and a pair of threaded fasteners 244 removably secure the switch modules 236, 238, 240, 242 to the lower wall of the lower housing shell 24. The location and the accessibility of the switch modules is particularly advantageous because it allows for easy replacement of worn-out modules. The switches in known operators are difficult to access and typically require taking the entire operator out from above the door to replace worn-out switches. In the arrangement of the present application, the modules 236, 238, 240, 242 are located on the casing 18 exterior and can be changed without removal of the entire operator 10 from its operating portion above the door. This reduces the maintenance time spent replacing worn-out switches and reduces overall maintenance costs.

Each of the switch cams 66, 68, 70 (i.e. the contact members) is adjustable relative to the output member 30 from the exterior of said housing 12 to enable the position within the range of contact member positions at which each contact surface of the cams 66m 68, 70 contacts its associated contact switch to be selected with respect to the range of open positions of said door panel. In the illustrated embodiment, each switch cam 66, 68, 70 is mounted to the output member 30 for rotation therewith and each contact switch is mounted adjacent 30 output member and its associated switch cam. Other alternative arrangements are contemplated. Each switch cam 66, 68, 70 is constructed and arranged such that adjustment of each switch cam 66, 68, 70 relative to the output member 30 is affected by rotating the cams 66, 68, 70 about the output member 30. As mentioned above, each of the cams 66, 68, 70 are mounted on the collar in a friction fit relation. As a result, the contact members can each be adjusted relative to the output member 30 by rotation thereof relative to the collar 82 and the output member 30 with sufficient torque to overcome the friction fit between the collar 82 and the cam bore.

The drive assembly 52 also comprises another series of thrust bearings 88 which are disposed over the connecting end portion 62 of the output member 30 and engaged with the interior side of wall portion 78. The generally circular drive member 54 is connected to the connecting end portion 62 as described above. The connecting end portion 62 has a threaded bore 89 formed therein and the drive member 54 has a shoulder surface 90 surrounding the periphery of the central bore with teeth 64. A headed threaded fastener 92 in the form of a bolt is inserted into the bore 89 with the head of the fastener 92 engaging the shoulder surface 90 to secure the drive member 54 in place. As with thrust bearings 74, thrust bearings 88 are not necessary, but are preferred to reduce frictional wear between wall portion 78 and the underside of the drive member 54.

The rearward wall of the lower housing shell portion 24 has a generally cylindrical input receiving portion 94 extending rearwardly therefrom with an opening 96 formed therethrough providing access to the interior of the housing portion 16. The bevel gear 58 is fixedly mounted on the forward end 95 of the drive assembly input member 56. Preferably, the interior of the bevel gear 58 and the exterior of the forward end 95 are toothed and fixedly intermeshed to provide for such fixed mounting but other secure connections may be used. The rearward end of the input member 56 defines a transmission connecting portion 98 in the form of a toothed pinion gear. The central portion of the input member 56 is rotatably supported by a pair of bearings 100, 102. The input member 56 is assembled inside the opening 96 of the receiving portion 94 so that the bevel gear 58 is positioned inside the interior of the housing portion 16 and the teeth of the bevel gear 58 are engaged with the teeth 60 on the underside of the drive member 54 in an intermeshed relationship. The connecting portion 98 of the input member 56 extends rearwardly and is accessible through the opening 96. As a result of this arrangement, rotation of the input member 56 and bevel gear 58 about the input member axis, which extends generally perpendicularly from the output member axis, causes the output member 30 to rotate about the output member axis via the intermeshed sets of gear teeth.

The drive member 54 also has a pin 104 mounted thereon and spaced radially from the output member axis. A cam follower 106 is rotatably mounted on the exterior of the pin 104. Although the cam follower 106 illustrated is rotatable, it is contemplated that the cam follower could be eliminated and the fixed pin 104 could function as the cam follower 106. The rotatable cam follower 106 is preferred to prevent friction wear during a camming operation which will be discussed in further detail below. The pin 104 and cam follower 106 may be considered to constitute an offset member. This offset member is not limited to the pin 104 and follower 106 arrangement and any structure may be used to provide the offset member. A camming structure 108 (shown fully in FIGS. 12*a* and 12*b*) has a forward end portion 110 and a pair of generally cylindrical connection rods 112 extending rearwardly from the forward end portion 110 located inside the drive assembly housing portion 16. The connecting rods 112 extend rearwardly through a pair of generally circular openings formed in the rear wall of the lower housing shell 24. A pair of sleeves 114 fit over the ends of the connecting rods 112 which extend rearwardly from the lower housing shell 24. The function of the camming structure 108 will be explained in further detail below. The upper cover plate 14 is fixed to the top of the lower housing shell half 24 to protect the components housed therein from damage and debris.

Figure 7:
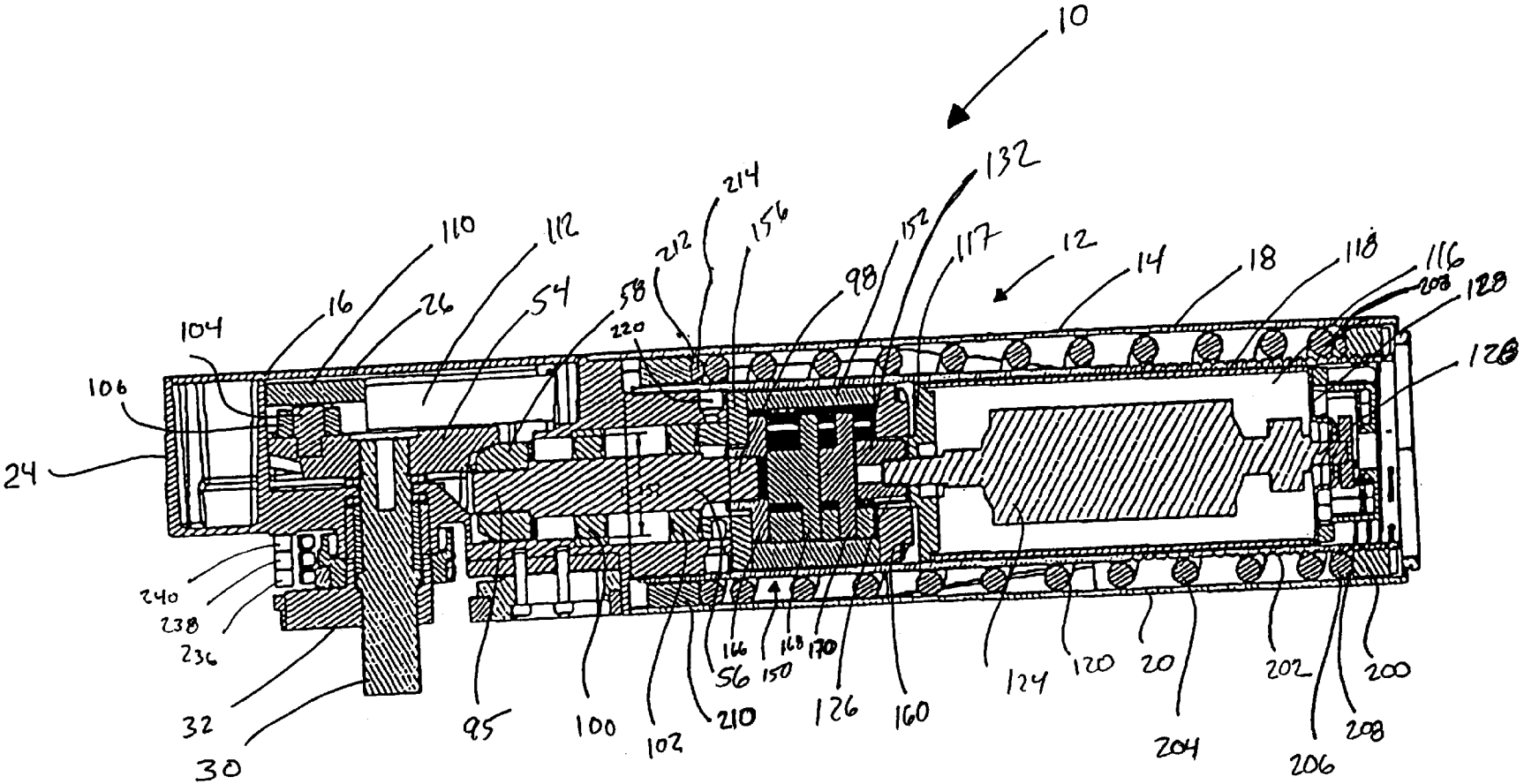
FIG. 7 is a cross-sectional view taken longitudinally through the operator along the axis of the motor.
Figure 8:
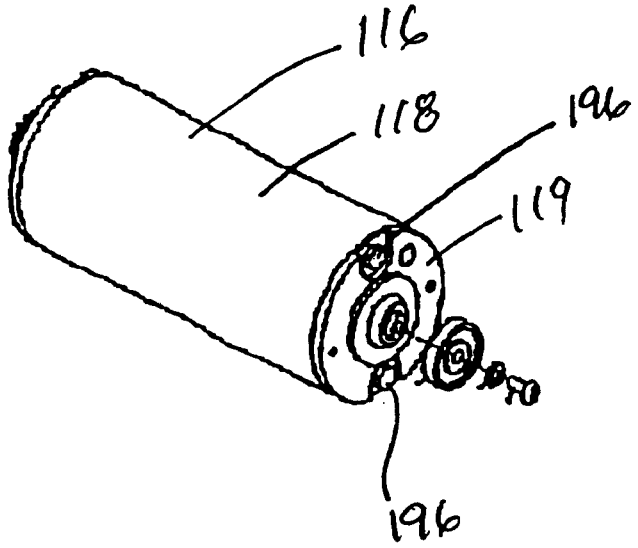
FIG. 8 is a perspective view of a D.C. motor utilized in the operator of the present invention, the perspective being taken from the rear of the motor.
Figure 9:
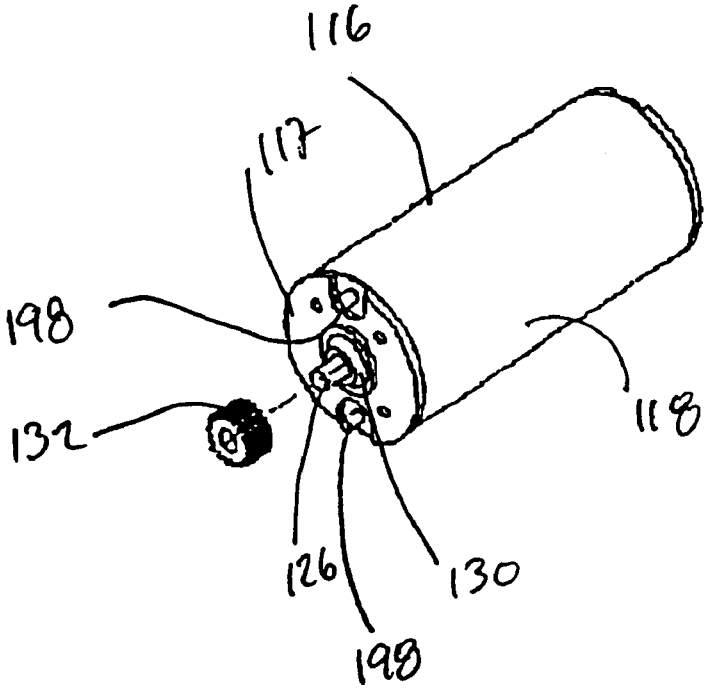
FIG. 9 is a perspective view of the D.C. motor of FIG. 8, the perspective being taken from the front of the motor.
Figure 10:
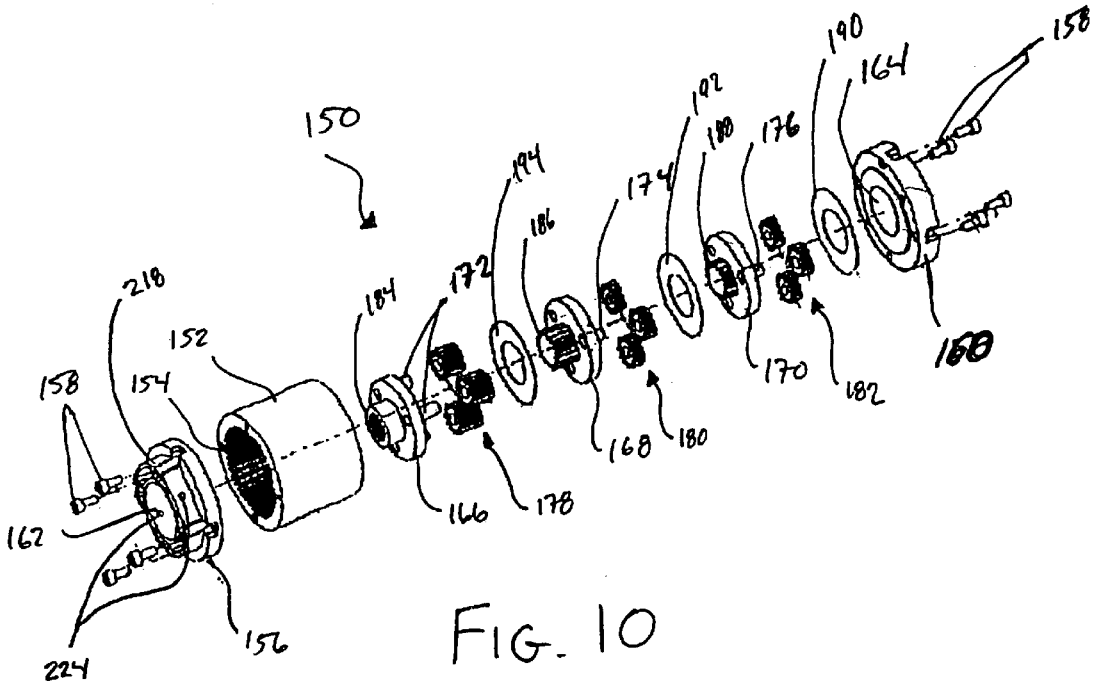
FIG. 10 is an exploded view of a reduction transmission utilized in the operator of the present invention clearly illustrating the compact planetary gear arrangement assembled therein.
Figure 11:
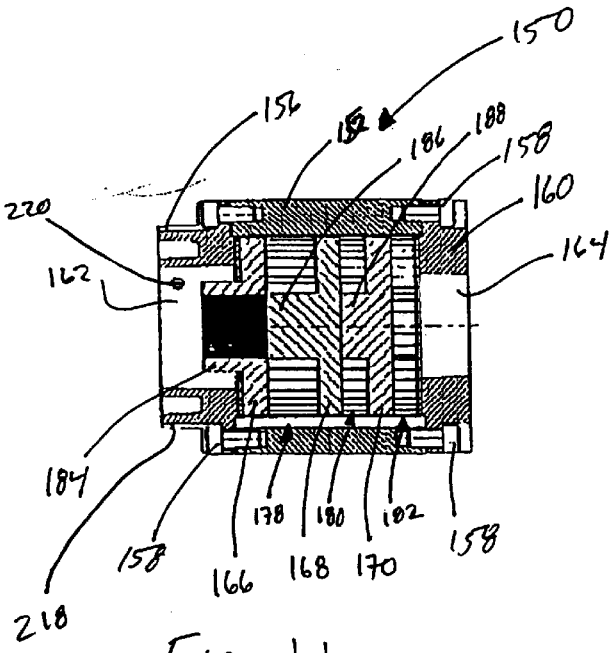
FIG. 11 is a cross-sectional view of the reduction transmission of FIG. 10.

FIGS. 8 and 9 illustrate a conventional D.C. motor 116. The D.C. motor has a cylindrical casing 118 and, as seen best in FIGS. 4 and 7, is received inside a generally cylindrical motor/transmission sleeve 120 which, in turn, is received inside the motor/transmission housing portion 14 of the casing 12. The casing 118 has a generally circular front wall 117 and a generally circular rear wall 119 secured thereto by conventional fasteners such as headed screws. Such conventional D.C. motors are well known and hence the details of the motor 116 will not be described in specific detail. It is preferred that the motor 116 be of the type whose rotational output can be reversed by reversing the polarity of the current flowing to the motor 116. A controller (not shown) is conventionally used to control the operation of the motor and perform such polarity switching. The use of such controllers for door operators is well-known and therefore such a controller will not be detailed herein. A set of wires 121 extend from the rear end of the motor 116 and an adapter 122 is provided on the free end of the wires 120 for connection to the controller.

The motor drive shaft 124 extends through the casing 118 and has a forward end portion 126 thereof extending through the front wall 117 and a rearward end portion 128 thereof extending through the rear wall 119. The forward end portion 126 is rotatably supported by a bearing 130 which is press-fit or otherwise mounted in an opening formed through the front wall 126. A motor output member 132 in the form of a spur or pinion gear is fixedly mounted to the front end portion 126 of the motor shaft 124. Supplying a direct electrical current to the motor 116 drives the motor shaft 124 in a conventional manner to rotate the motor output member 132 about a motor driving axis (also referred to as a motor output axis) which extends coaxially with the shaft 124 and perpendicularly to the operator output member axis. In the illustrated embodiment the drive assembly input member 56, the transmission 150 (described below), and the motor shaft 124 share a common axis; however, these elements could be rotated about offset axes and additional gearing could be provided through the transmission to provide for proper power delivery. The coaxial arrangement illustrated is preferred due to space considerations and to obviate the need for additional gearing and its associated part and assembly costs.

A generally circular member 134 is fixedly mounted to the rearward end portion of the shaft 124 for rotation therewith. The circular member 134 has portions of magnetized material spaced circumferentially about the outer periphery thereof at evenly spaced increments. A motor metering device 136 is secured to the rear wall 119 of the motor by a pair of threaded fasteners 138. Wires 140 extend from the metering device 136 and have an adapter 142 on the free end thereof which connects to the controller. The metering device 136 includes a Hall sensor which is responsive to the magnetic material in the circular member 134. The Hall sensor of the device 136 cooperates with the controller to determine the rotational speed of the motor 116 and the amount the door has traveled about its axis by measuring the number of rotations of the circular member 134 and speed of such rotations. This information is then used by the controller to control functioning of the operator 10 in a manner that is known in the art and thus will not be detailed herein.

The operator 10 of the present invention also includes a reduction gear transmission, generally indicated at 150. The transmission 150 comprises an generally cylindrical outer housing 152. The interior of the outer housing 150 is splined with a set of axially extending gear teeth 154 which define a ring or orbit gear. A generally circular front cover 156 closes the front end of housing 152 and is secured to the housing 152 by conventional fasteners such as threaded screws 158. A generally circular rear cover 160 closes the rear end of the housing 152 and is also secured to the housing 152 by conventional fasteners such as threaded screws 158. The front cover 156 has a central opening 162 providing access to the transmission interior and the rear cover 158 has a central opening 164 providing access to the transmission interior.

Three planet gear carriers 166, 168, 170 are received inside the housing 152. Each planet carrier 166, 168, 170 has three planet gear mounting pins 172, 174, 176, respectively extending rearwardly therefrom. Three sets of three planet gears each, generally indicated at 178, 180, and 182, are rotatably mounted on the planet gear mounting pins 172, 174, 176, respectively. Although the illustrated embodiment illustrates three carriers each carrying three planet gears, the number of carriers, gears and the diameters thereof may be varied to achieve the desired reduction ratio. The ratio may be increased for applications with doors of greater weight, which require more torque to pivot. Conversely, the ratio may be decreased for applications with lighter doors where a great deal of torque is not needed.

Each of the carriers 166, 168, 170 also has a carrier output member 184, 186, 188. The carrier output members 186,188 of the rear and central carriers 168,170 are in the form of integrally formed pinion gears and the output member 184 of the forward carrier 166 is in the form of a splined bore having a series of axially extending teeth. The rear planetary gear set 182 is mounted on pins 176 and the rear carrier 170 is disposed inside the housing 152 adjacent the rear cover 160 with a metal annular washer 190 positioned between the planet gears 182 and the interior face of the rear cover 160 to prevent frictional wear. The planet gears of set 182 are intermeshed with the teeth 154 lining the inside of the housing 152. When the operator 10 is assembled, the motor output member 132 is inserted in through the opening 164 of the rear cover 160 and the teeth of the motor output member 132 are intermeshed with the teeth of the planet gears of set 182. As a result of this arrangement, the planet gears of set 182 will rotate about their respective axes when the motor output member 132 is rotatably driven by the motor 116 and will travel circumferentially about the transmission axis in an intermeshed relationship with the teeth 154 of the housing 152. The circumferential travel of the planet gears of set 182 causes the rear carrier 170 to rotate about the transmission axis at a rate slower than the motor output member 132.

The gears of central planet gear set 180 is mounted on pins 174 and the central carrier 168 is disposed adjacent the rear carrier 170 with a metal annular washer 192 positioned between the planet gears 180 and the forward face of the rear carrier 170 to prevent frictional wear. The planets gears of set 180 are intermeshed with the teeth of the output member 188 of the rear carrier 170 and the interior teeth 154 of the housing 152 such that rotation of planet gear carrier 170 will cause the planet gears of set 180 to rotate about their respective axes, which in turn causes the planet gears of set 180 to travel circumferentially with respect to the transmission axis in an intermeshed relation with teeth 154 (i.e., the orbit gear). This circumferential travel rotates the central carrier 168 about the transmission axis at a rate slower than the rear planet gear carrier 170.

The gears of forward planet gear set 178 are rotatably mounted on pins 172 and the forward carrier 166 is disposed adjacent the central carrier 168 with a metal annular washer 194 positioned between the planet gears 178 and the forward face of the central carrier 168 to prevent frictional wear. The planet gears of set 178 are intermeshed with the teeth of the output member 186 of central carrier 168 and the interior teeth 154 of the housing 152 such that rotation of central planet gear carrier 168 rotates the planet gears of set 178 about their respective axes, which in turn causes the planet gears of set 178 to travel circumferentially with respect to the transmission axis in an intermeshed relation with teeth 154. As before with carriers 168 and 170, this circumferential travel rotates the forward gear carrier 166 about the transmission axis at a rate slower than the central planet gear carrier 168.

When the operator 10 is assembled, the connecting end portion 98 on the output drive assembly input shaft 56 is received through the opening 162 in front cover 156 and inserted into the output member 184 of the forward carrier 166. The teeth on the connecting end portion 98 engage the teeth on the interior of the output member 184 in a fixedly intermeshed relationship such that rotation of the forward carrier 166 rotates the input member 56, which in turn drives the output drive assembly 52 in the manner described above to rotate the operator output member 30. Thus, the output member 184 of the forward carrier 166 may be considered to function as the transmission output.

Because each successive planet gear rotates slower than the output member which drives its planet gears, the rotational speed is significantly lower at the transmission output in comparison to the rotational speed of the motor output member 132. As a result, the torque at the transmission output is increased in comparison to the effective torque of the motor 116. This allows high speed/low torque motors (which are less expensive and smaller than low speed/high torque motors) to be used to drive doors with weights which they otherwise could not effectively drive.

The use of a planetary gear arrangement in the reduction transmission 150 is considered to be particularly advantageous because it has an more compact design in comparison to conventional rack/pinion transmission which are utilized in conventional door operators. With conventional door operators, to increase the reduction ratio of a rack/pinion transmission the overall length of the rack must be increased. This results in an increased overall operator length, which may be unsuitable for particular applications due to space considerations and building code requirements. With planetary gear-type transmission, the reduction ratio of the transmission can be greatly increased without significantly increasing the length of the transmission because a greater number of gear teeth can be provided in less space than in a rack/pinion arrangement. For example, to increase the reduction ratio in the illustrated invention, another carrier and another set of planet gears could be assembled inside the housing and the only axial length difference realized would be the axial length of the additional set of gears and their associated carrier. This provides superior savings in overall operator space over conventional arrangements. Further, the transmission 150 of the present invention is also advantageous because no bearings are needed in the gear train, thus obviating the costs and assembly efforts associated with purchasing and mounting such bearings.

Another significant advantage of the transmission 150 illustrated and described herein is that a variety of such transmissions having varying reduction ratios can be assembled the operators in a modular fashion. Specifically, it is contemplated that a bar code or some marking is placed on the operator during assembly. This coding or marking would indicate the appropriate reduction ratio or the part number for the appropriate transmission. The reduction ratio would be selected based on the application for which the operator is to be used. High load operations generally require more torque, and hence and a higher reduction ratio, and low load operations generally require less torque a lower reduction ratio. Also, in low energy applications, building codes require that doors move below a certain speed or carry below a certain amount of energy. For such low energy applications, the low torque would also be desired to ensure that the door moves slowly, and hence a low reduction ratio transmission would be an appropriate selection. Based on the coding or marking indicating the type of transmission needed, the appropriate transmission would be selected either manually or by an automated system from an inventory comprising a variety of transmissions having different reduction ratios and assembled into the operator.

This modular assembly concept is particularly advantageous over existing manufacturing methods. In current manufacturing practices, a different operator is made for each application, thus requiring a variety of assembly lines and a number of different workers or mechanized assembly machines performing similar tasks on different lines. By assembling the operator 10 of the present invention in a modular fashion, the same basic components can be used for each operator and the certain components can be selected from a given variety to tailor the operator to a given application. The stop member 132 and the transmission 150 are the two components which often have the most varied requirements and hence are best suited for this modular assembly concept. Also, certain components of the camming structure 108 can widely vary for given applications, and thus modular assembly principles are also well suited for assembling the camming structure 108, as will be appreciated below.

Because the planetary gear arrangement in the present transmission 150 affords such a high reduction ratio in a small amount of space, it is possible to use the motor 116 and transmission 150 together without the output drive assembly 52 and directly connect an operator output member similar to output member 30 to the transmission output so that the output member, the transmission, and the motor all share a common axis. The output member can then be connected directly to the door coaxially with the door axis. It is believed that there have been no commercially successful axially mounted operators on the market because of the space concerns related to achieving the appropriate reduction ratio in the transmission. The present transmission achieves such a superior reduction ratio per volume occupied that it is possible to utilize the door operator in such an axially aligned manner.

Further, the present transmission 150 also provides the door operator 10 with sufficient flexibility to be utilized with sliding doors as a result of its advantageous reduction ratio per unit volume. For use with a sliding door, the motor 116 and the transmission 150 would again be used without the output drive assembly 52 and an output member similar to output member 30 would again be connected directly to the transmission. The directly connected output member can then be connected to a pulley (or have the pulley pre-connected thereto) which engages with a belt for driving the sliding door, as is conventional in sliding door operators. Rotation of the output member rotates the pulley to drive the belt to affect door sliding. The direction of the output member rotation could be reversed simply reversing the polarity of the current being delivered to the motor 116, thus sliding the door in the opposite direction.

Referring now to FIGS. 4 and 7, the motor 116 and the transmission 150 are assembled together within the motor/transmission sleeve 120 with the transmission facing out the forward end of the sleeve 120 and the motor 116 facing out the rear end of the sleeve 120. The motor has a pair of axially extending fasteners 196 which extend through the entire length thereof and have forward threaded end portions 198 protruding from the front wall 117. The forward end portions 198 are received within a pair of threaded bores (not shown) which are formed in the rear cover 160 of the transmission 150. The fasteners 198 can be tightened with a screwdriver or a similar tool suitable for fastener rotation to secure the motor 116 to the transmission 150. The housing 12 has an opening at the rearward end thereof that provides access to the interior thereof The motor 116 is positioned within the housing adjacent to the opening 199 such that the fasteners 198 can be accessed through the opening 199 for selective manipulation thereof for tightening and loosening the same. In the illustrated embodiment, the motor metering device 136 may have overall diametric dimension that is small enough to not interfere with access to the fasteners 198 by a screwdriver or the like. Alternatively, the metering device 136 may have an overall diametric dimension large enough to cover the fasteners 198 and obstruct as to the same. In that event, the metering device 136 needs to be removed prior to accessing the fasteners 198. The motor 116 and opening 199 are configured with respect to one another (a) to enable the motor 116 to be moved out of the operating position thereof outwardly through the opening 199 without disassembling the housing 12 and (b) to enable the motor 116 to be moved inwardly through the opening 199 back into the operating position thereof.

In the operative position thereof within the housing, the motor 116 is coupled to the operator output member 30 via the transmission 150, the motor output member, and the output drive assembly 32 such that operation of the motor affects rotation of the operator output member 30. To remove the motor 116 from the operative position thereof for servicing such as repair or replacement or inspection, the technician opens the header 508 by removing the face panel 510 thereof and then manipulates the fasteners 198 in a motor releasing manner by rotating the same in an untightening direction through the opening 199 to disengage the same from the transmission 150. Then, the technician removes the motor 116 from the operative position thereof by withdrawing the same from the sleeve 120 and housing 12 through opening 199 and moves the same out from the header 508. The motor 116 can then be serviced by inspecting the same to determine its operational condition and then as needed either repair the motor 116, reposition the motor 116 back in the operative position thereof, or provide a replacement motor 116 and position that in the operative position. If needed, the technician may disconnect the motor 116 from its power supply and/or its controller. To move the motor 116 or its replacement back into the operative position, the technician inserts the motor 116 or replacement motor into the housing 12 and sleeve 120 through the opening 199 so that the fasteners 198 align with the bores on the transmission 150 for insertion therein. The technician then selectively manipulates the fasteners 198 in a motor securing manner to secure by rotating the fasteners in a tightening direction to threadingly engage fasteners 198 within these bores to secure the motor 116 in the operative position thereof and reconnects the motor 116 or replacement motor to the power supply and/or controller. Finally, the technician replaces the face panel 510 of the header 508 and fastens the same by suitable fasteners or snap clips.

Thus, the invention may be considered to provide a method for servicing a door operator comprising: (a) releasing an installed motor 116 by manipulating the fasteners 198 in a motor releasing manner; (b) moving the released motor out of the operating position thereof outwardly through the opening 199 without disassembling the housing 12; providing a reinstallation motor, the reinstallation motor and the opening 199 being configured with respect to one another to enable the reinstallation motor to be moved inwardly through the opening 199 to position the reinstallation motor in the operating position thereof within the housing 12 interior; moving the reinstallation motor inwardly through the housing opening 199 to install the reinstallation motor in the operating position within the housing 12 interior such that the reinstallation motor is coupled to the operator output member 30 such that operation of the reinstallation motor rotates the output member 30 so as to move the door panel between the open and closed positions thereof; and securing the reinstallation motor in the operating position within the housing interior.

Providing the reinstallation motor may be accomplished by servicing the released motor 116 and then reinstalling the same as the reinstallation motor. During such servicing the technician may simply repair the released motor. Also, the technician may simply inspect the motor to determine its operation condition. If such inspecting results in a determination that the motor does not require repair, that would conclude the servicing. If such inspecting reveals that the motor 116 requires repair, the servicing may further comprise repairing the motor 116 to provide the reinstallation motor.

Providing the reinstallation motor may also comprise providing a replacement motor similar, but note necessarily identical, to motor 116. This may be done simply to replace the motor 116 or as a result of inspecting the released motor 116 and making a determination that the released motor is damaged and should not be repaired (either because it is impossible or impractical).

This arrangement provides for easy removal and maintenance of the motor 116. Specifically, the motor 116 can be removed from the operator 10 for maintenance or replacement without having to dismount the operator 10 from above the door. In conventional operators, the entire operator had to be removed and disassembled to service the motor. With the present arrangement, such steps are obviated, thus simplifying maintenance and reducing overall maintenance time, which in turn reduces overall maintenance costs.

An annular spring force adjusting member 200 is threadingly engaged with a threaded rear end portion 202 of the motor/transmission sleeve 120. A coiled door return compression spring 204 is slidably mounted over the exterior of the sleeve 120 with a rear volute 206 of the spring 204 engaging a forwardly facing spring bearing surface 208 of the spring force adjusting member 200. A rearward annular ring 210 which comprises a portion of the camming structure 108 is slidably mounted over a forward end portion of the sleeve 120 and a spring bearing surface 212 thereof is engaged with the forward volute 214 of the spring 204. When the operator 10 is assembled, the two apertures 216 on the ring 210 receive the rearward end portions of the connecting rods 112 and a forwardly protruding portion 218 of the front transmission cover 156 is received inside the receiving portion 94 on the lower housing shell 24. A pair of radially aligned fasteners 220 are inserted through apertures 222 on the receiving portion 94 and receiving in threaded bores 224 on the front transmission cover 156 to secure the transmission 150 (and hence the motor 116 fastened thereto) in place. In this position, the spring 204 is stressed between the forwardly facing and rearwardly facing spring bearing surfaces 208, 212 of the spring force adjusting member 200 and the annular ring 210, respectively. Mounting the spring 204 about the exterior of the motor 116 and the transmission provides the operator 10 with an overall increased compactness and better utilizes space in comparison with known operators.

Figure 12B:
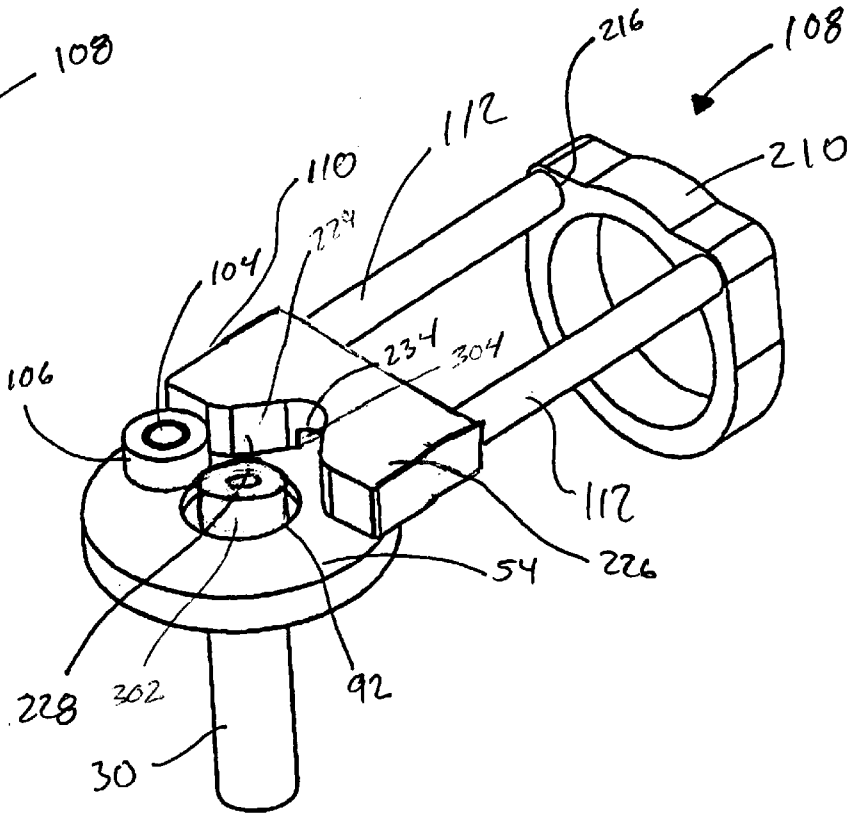
FIG. 12*b* is a perspective view similar to FIG. 12*a*, with the camming structure and the drive member being depicted as they would be with the door opened degrees from its closed position.
Figure 12A:
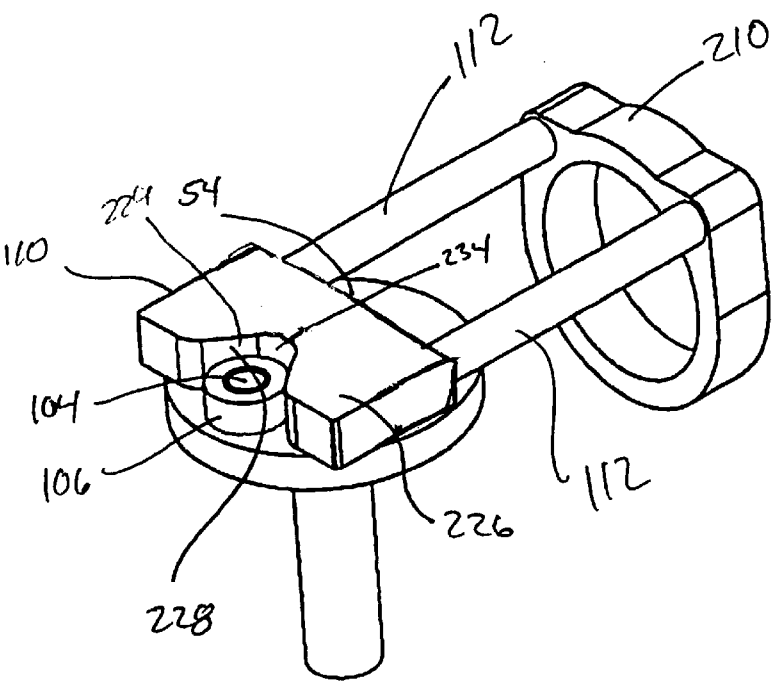
FIG. 12*a* is a perspective view of a camming structure and an drive member of the output drive assembly utilized in the operator of the present invention, the camming structure and the drive member being depicted as they would be with the door in the closed position.
Figure 12C:
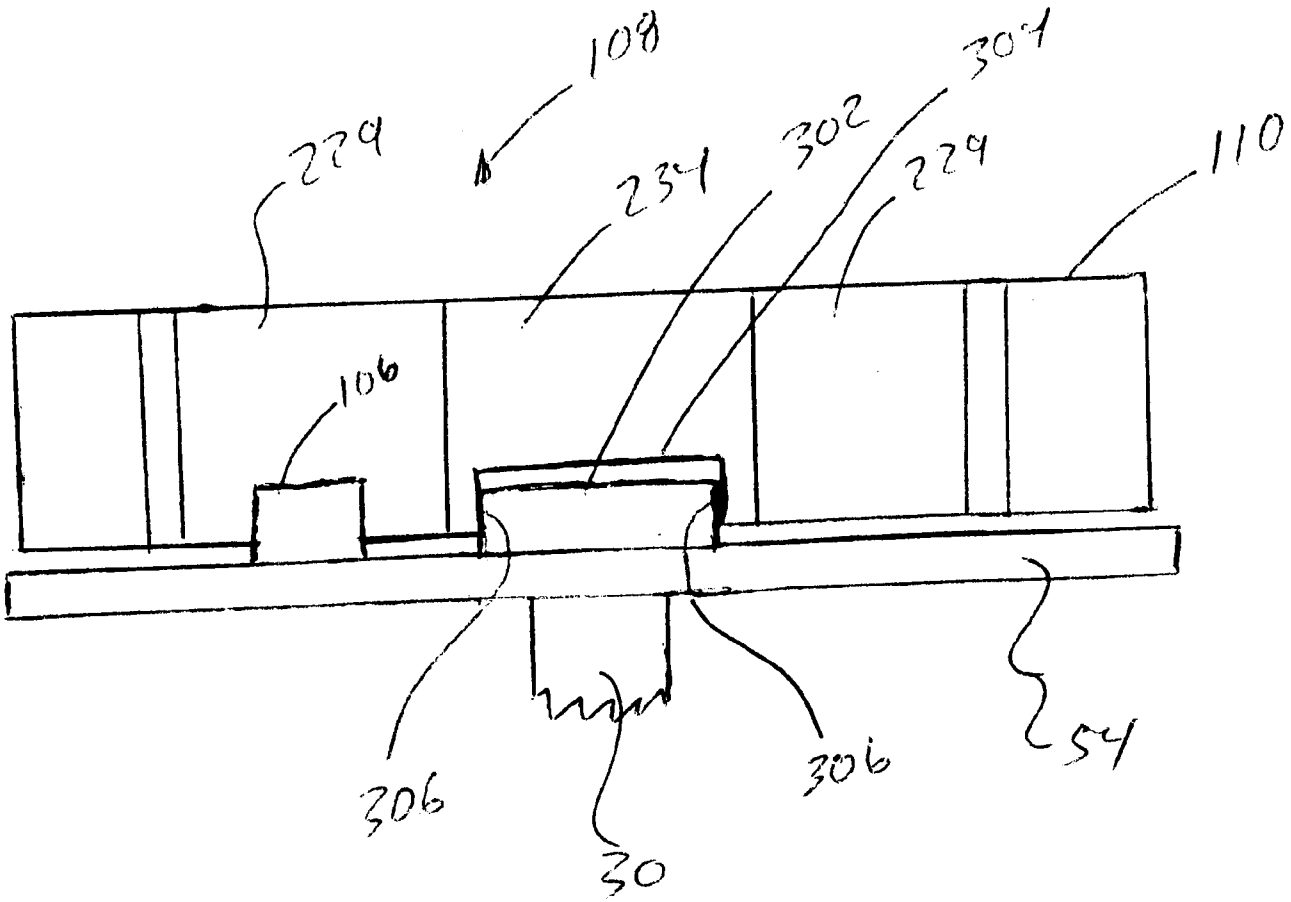
FIG. 12*c* is an elevated profile view showing the notch in the underside of the cam structure and the force receiving member on the driving member.

As can be best seen in FIGS. 12*a* and 12*b*, the forward end portion of the cam structure 108 has a cam member 226 that provides a contoured cam surface 228. An upper plate 230, which is not shown in FIGS. 12*a* and 12*b*, is placed over the cam member 226 and is shown in the other Figures. The cam surface 228 engages the cam follower 106 so that the cam follower 106 rides along the cam surface 228 to cam the cam structure 108 in a cam travelling direction radially away from the operator output member axis as the output member 30 is rotated under power from the motor 116 in a door opening direction. As a result of the cam structure 108 being cammed radially away from the output member axis, the annular ring 210 slides rearwardly in the cam travelling direction over the motor/transmission sleeve 120 to compress the spring 204 between the spring bearing surfaces 208, 212. When the power being delivered to the motor 116 ceases, the return spring 204 extends to move the cam structure 108 in the cam travelling direction back towards the output member axis so that the cam surface 228 thereof cams the cam follower 106 so as to drive the output member 30 is a door closing direction.

It should be noted that the spring 204 applies force to the output member 30 through the cam follower 106 and the drive plate 54 in the door closing direction rather than through a gear arrangement whereas the motor 116 and transmission 150 drive the output member 30 through the gear arrangements of the output drive assembly 52 and the transmission 150. This "split path" force transmission—transmitting door opening forces via a geared path and transmitting door closing forces via a separate path—is advantageous because it reduces wear and tear on the gear teeth which will eventually produce backlash or loose play between intermeshed gears. In conventional rack/pinion arrangements, forces which open the door panel 506 are transmitted from the motor via the geared rack/pinion arrangement and the forces which close the door are transmitted from the return spring also via the same geared rack/pinion arrangement. Thus, the gear teeth wear down more rapidly in the conventional arrangement because both the opening forces and the closing forces are transmitted through the same gear teeth. In contrast, the present arrangement reduces wear and tear on the teeth of the transmission 150 and the output drive assembly 52 because forces are transmitted through the gears thereof only during the door opening stage of the door panel's movement. The door closing forces are transmitted via the camming structure 108 and cam follower 106 so that the load is not being carried by the gears during this stage of the door panel's movement. Although the radially offset cam follower/camming structure arrangement is disclosed and considered the most suitable arrangement, other split path arrangements may be used to relieve the door closing load from the gears which drive the door in the opening direction.

The contoured shape of the camming surface 228 provides an angled portion 229 that extends at an angle with respect to the cam travelling direction that allows the spring 204 to apply a spring force to the offset cam follower 106 which is non-linear throughout the door's path of travel. Specifically, as the cam follower 106 cams along the angled portion 229, the force stored in the spring or applied thereby varies non-linearly as a function of the slope of the angled portion 229 with respect to the cam travelling direction. As the slope approaches zero, the force the less change in compressed/relaxed spring length per degree of output member 30 rotation. Likewise, as the slope approaches ninety degrees, the more change in compressed/relaxed spring length per degree of output member 30 rotation.

Because the cam surface 228 has an angled portion 229, as the follower 106 cams along the angled portion 229, forces the transverse to the cam travelling direction will be created. One way to prevent the cam structure 108 from simply moving transversely with respect to its travelling direction is to provide a pair of guiding members 300 fixed to the interior of the housing 12 that slidably engage to opposing sides of the cam member 110. This functions to transmit these transverse forces to the housing 12 itself.

To alleviate the transfer of forces to the housing 12, the driving member has a force receiving member 302 mounted concentrically on its rotational axis and the cam member 110 has a notch 304 extending through the central underside thereof in the cam travelling direction. The notch 304 provides a pair of force transmitting surfaces 306 the engage opposing sides of the force receiving member 302 to transmit the transverse forces thereto and alleviate force transmission to the housing 12 via guide members 300.

Figure 13:
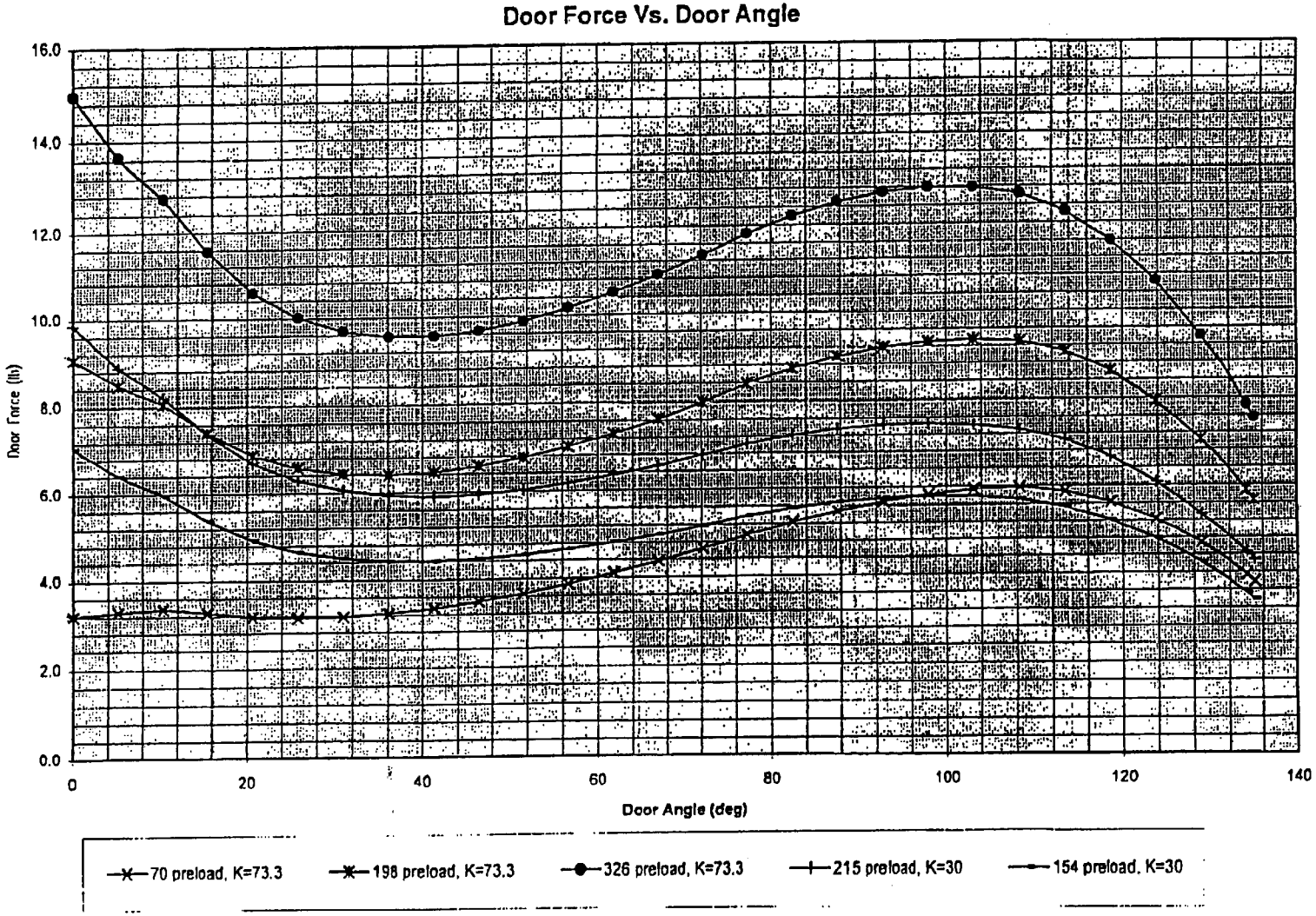
FIG. 13 is a graph illustrating the amount of force (in pounds) applied in the closing direction of the door versus the number of degrees from which the door is pivoted from its closed position with the force being illustrated along the vertical axis and the number of degrees being illustrated along the horizontal axis.

The graph of FIG. 13 illustrates a number of traces showing the door closing forces applied by the spring throughout the door panel's path of travel in which the door panel's position is shown in degrees. Referring to the top trace on the graph, the highest door closing force is applied at the door's fully closed position (0 degrees from closed), then decreases to its lowest door closing force around 35 to 40 degrees from filly closed, and increases to its second highest closing force is applied between 90 and 100 degrees from filly closed. This force profile is selected for outside door applications where the highest closing forces are needed at fully closed and near 90 degrees open, the two positions at which higher forces are needed to overcome wind forces. Specifically, the wind forces are higher near 90 degrees because of the increased effective surface area of the door panel 506 and near fully closed because of both the pressure differential created as a wind blows by the door panel 506 and draws air outwardly from the building interior through the door opening and the resistance of the seals between the door panel 506 and its frame 504. A high force is also needed rear fully closed in order to overcome friction force of the door seals.

With conventional operators, this non-linear force profile could not be achieved because the door closing force would always be lower near fully closed as a result of the spring extending towards it neutral position. Further, because certain building codes specify maximum door closing forces, a satisfactory door closing force near the fully closed position cannot be achieved with a conventional operator simply because the maximum door closing force is limited and the door closing force will always decrease from the maximum towards the fully closed position as a result of its linear nature.

It should be understood that the contour of the cam surface 228 can be manipulated to provide desired door force profiles for various applications. In fact, it is contemplated within the present invention to pre-fabricate a variety of camming members 226 with cam surfaces 228 of varying contours or profiles and to assemble the camming members 226 into the operator during assembly in a modular fashion in accordance with discussion set forth above. Depending on the specifications or other information which is marked or otherwise encoded on the operator, the assembly worker or an automated machine selects the appropriate camming member 226 and mounts the same to the camming structure 108 and then assembles the camming structure 108 into the operator. Thus, a number of operators which are designed to provide different door closing forces with varying profiles can be assembled on a single assembly line. Combining the modularity of the camming member 226 with the modularity of the transmission 150 and the stop member 32 creates great manufacturing flexibility by allowing a wide variety of operators which meet different specification to be assembled using the same base components and increases overall manufacturing efficiency.

The profile of the cam surface 228 may be asymmetrical with respect to the cam travelling direction so that the force transmission provided by the camming action is different in the opposite opening directions of door movement from the closed position thereof.

The camming feature discussed herein may be provided by providing an eccentric driver member and a cam structure with one or more cam followers providing the cam surface thereof as shown in U.S. Pat. No. 5,193,647, the entirety of which is hereby incorporated into the present application by reference.

Another advantage of the camming surface 228 illustrated is that it is symmetrical in a plane taken perpendicularly to the operator output member axis. This symmetry provides the same door closing force profile regardless of in which direction the door is being opened to allow the door to function in a "non-handed" manner in conjunction with the reversible motor 116. In the door operator art, the door operators are labeled either right or left handed depending on which direction they will open the door because the rack/pinion arrangements of these operators will only drive the door in one direction. The properly handed door operator must be selected prior to installation depending on the particular door opening direction desired. In contrast, the operator 10 of the present application can pivot a door in either a clockwise or a counterclockwise direction simply by reversing the polarity of the current being delivered to the motor 116. Because the cam surface 228 is symmetrical, the door force profile will be substantially the same regardless of which direction the door is pivoted. Thus, there is no need to provide left and right-handed door operators because the door operator 10 of the present application can be utilized in either manner. This feature further increases manufacturing efficiency because only one type of door operator need be made, rather than two types which pivot doors in opposite directions. Furthermore, the swing of the door can later be reversed without having to remove the operator 10 and install a new one because all that needs to be done is to reverse the polarity of the current being delivered to the motor 116 as described above. A switch in the controller could be provided to perform this function.

A variation on this non-handed or bi-directional feature would be locating switches on either side of the door, whether the switch be manually operated by hand, a pressure plate which senses when a person has stepped on the plate, or some other sensor, such as an electronic eye, and connecting the switches to the controller such that actuation of either switch causes the door to swing away from the side of the actuated switch. In this arrangement, the door would always swing away from the person passing through it. The use of a coiled compression spring in the present door operator 10 is advantageous in this context because it allows the door to be spring returned to the closed position from either direction. Some known door operators have a clock spring engaged with the output member to provide the closing force. The problem with this arrangement is that a suitable return force is applied in only one direction because the spring is compressed in only one rotational direction. In the present operator 10, the compression spring 204 will be compressed no matter which direction the door rotates and hence the spring 204 will apply a door closing force in either direction to move the door towards and into its full closed position.

The use of a linear compression spring is also advantageous because it allows the door to be spring returned even when it has been pushed beyond its fully closed position in an opening direction opposite the direction which the motor 116 drives the door. The ability to open opposite the direction in which the motor drives the door is referred to in the operator art as "breakout" and the ability of the spring to close the door after breakout if referred to as "return from breakout". Many building codes require breakout in door operators so that the doors can be manually opened opposite the intended opening direction during emergency situations. This return from breakout is advantageous because it ensures that the door will close after breakout has occurred. With operators which incorporate clock springs, the return force is typically insufficient to return the door from breakout and thus the door will remain open until manually closed.

The "valleyed" or concave profile of the U-shaped cam surface 228 of the camming member 226 also allows the door operator 10 to be "self-centering" as a result of the spring being in its most extended condition when the cam follower 106 is positioned in the U-shaped center portion 234 of the camming surface 228, as shown in FIG. 12*a* (i.e., the portion where the legs of the U-shape converge). As a result, the output member 30 is biased into its fully closed position because the additional force in one of the opposing opening directions would be required to compress the spring 204.

The spring force adjusting member 200 rotates for axial movement along the threaded end portion 202 of the sleeve 120. As the member 200 is rotated to move further axially inwardly in the longitudinal direction of the spring, the spring 204 is further compressed and will thereby apply a higher door returning force to the drive plate 54 and the output member 30. As the member 200 is rotated to move further axially outwardly, the spring is allowed to extend and will thereby apply a lower door returning force. This adjustablity provides the operator 10 with the flexibility to have the door return forces thereof easily adjusted. Thus, the same operator can be adjusted from a high energy operator to a low energy operator simply by rotating the adjusting member 200 to move the member 200 rearwardly along the rear end portion 202 through its range of adjusting positions. Finer adjustments between high and low energy can be made to accommodate varying door force specifications. Specifically, the range of adjustments is infinite as a result of the threaded relationship. Further, the wide adjustability range allows the same operator to be used for different applications, thereby allowing the manufacturer to produce one door operator for a wide range of needs. This features further enhances the operator's flexibility when used in conjunction with the modular assembly components discussed above.

As can be appreciated from this construction, the present invention can be said to provide a method for adjusting spring force in a door operator comprising moving the spring force adjusting member 200 in the longitudinal direction of the spring 204 to a selected position within its range of adjusting positions such that the spring 204 is stressed (compressed in the illustrated embodiment) to an extent determined by the selected position of member 200. This adjusts the amount of spring force that the spring applies to the operator output member 30 during spring driven rotation thereof. Moving the adjusting member 200 may be done by rotating the adjusting member 200. To access the adjusting member 200, a technician may have to remove the upper half of the housing 12 prior to moving the same and thereafter replace the upper half of the housing 12 in its original position. To do this, the operator 10 may have to be disconnected and removed from the header of the door assembly.

Figures 15A, 15B, 15C:
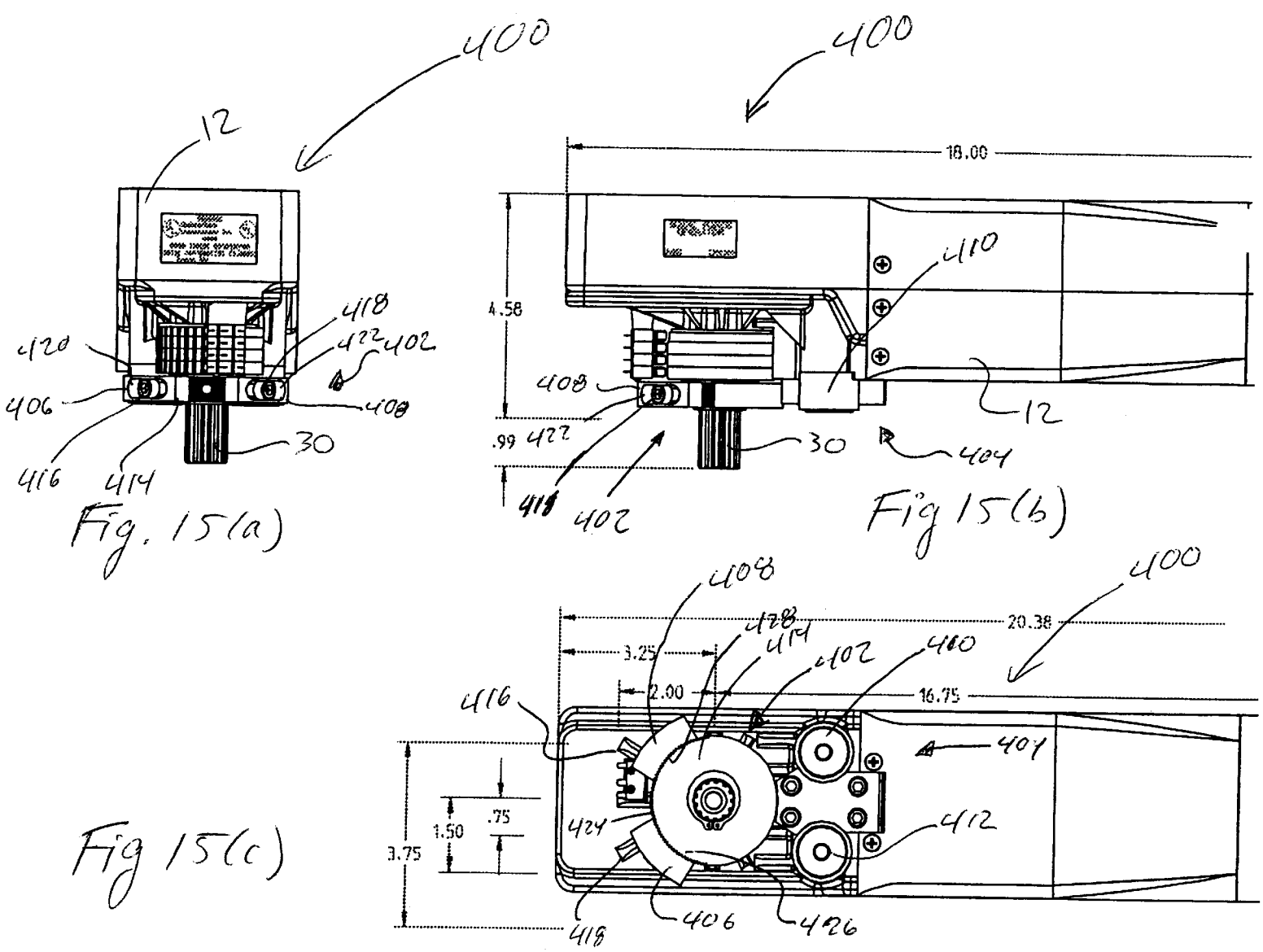
FIG. 15(*a*) is an elevated end view of a door operator of the invention with an alternative stop arrangement.

FIGS. 15*a* through 15*c* illustrate a door operator 400 having an alternative arrangement for the adjustable stop members thereof. The swing door operator 400 may be of any type of door operator and as illustrated has a construction like operator 10 discussed hereinabove. The operator 400 has an operator stop member, generally indicated at 402, mounted to said output member 30 and a fixed operator stop member, generally indicated at 404 mounted to the housing 12. The operator stop member 402 is adjustably movable relative to the output member 30 to provide the range of relative movements and comprises a pair of spaced apart stop members 406, 408 that are each adjustably movable relative to the output member 30 generally circumferentially with respect to the axis thereof. The fixed stop member 404 comprises a pair of spaced apart stop members 410, 412 fixed to the underside of the housing 12 adjacent the output member 30.

A mounting structure 414 is fixed to said output member 30 and a pair of fasteners 416, 418 are constructed and arranged to fix the spaced apart stop members 406, 408 to the mounting structure 414. The fasteners 416, 418 are constructed and arranged to release the spaced apart stop members 406, 408 for adjusting movements thereof. Specifically, each of the spaced apart stop members 406, 408 has an elongated slot 420, 422 extending generally circumferentially with respect to the rotational axis of the output member 30, the mounting structure 414 has a pair of spaced apart threaded bores (not shown) and the fasteners 416, 418 are each threaded for receipt in said bores. The threaded fasteners 416, 418 are received through said elongated slots 420, 422 and in threaded relation within said threaded bores to fixed said spaced apart stop members 406, 408 to said mounting structure 414. The mounting structure 414 also has a plurality of engaging teeth 424 thereon and each of said spaced apart stop members 406, 408 has a plurality of engaging teeth 426, 428 engaged in intermeshing relation with the engaging teeth 424 of said mounting structure 414 to prevent relative circumferential movement of said spaced apart stop members 406, 408 relative to said mounting structure in cooperation with said fasteners 416, 418. To adjust the positioning of one of the spaced apart stop members 406, 408, the appropriate fastener 416, 418 is untightened to the extent necessary to permit the teeth 426, 428 to be disengaged from mounting structure teeth 424. Then the stop member 406, 408 is moved circumferentially to the desired position and the fastener 416, 418 is retightened to re-engage the teeth sets 424, 426, 428 and fix the stop member 406, 408 in place.

The term swing door operator is used in the specification and in the appended claims to cover operators that pivot a single door panel (including balanced door panels) and operators that pivot the proximal panel of a bi-fold or tri-fold door panel assembly. No aspect of the invention is to be limited solely to single panel door panel arrangements.

The present invention is intended to cover arrangements wherein the motor provides door movement in the opening direction thereof and the spring structure provides door movement in the closing direction thereof; arrangements wherein the spring structure provides door movement in the opening direction thereof and the motor provides door movement in the closing direction thereof; arrangements wherein the motor provides door movement in the opening direction thereof and then the motor is reversed to assist the spring to provide door movement in the closing direction thereof; and arrangements wherein the motor assists the spring to provide door movement in the opening direction thereof and then the motor is reversed to provide door movement in the closing direction thereof without assistance from the spring structure. Certain aspects of the invention may be practiced irrespective of whether a spring structure is used in the operator at all.

The present invention may be applied to high energy door applications wherein a plurality of safety sensors are used to detect the presence of persons and objects in the path of a moving door panel. The present invention may be applied to low energy applications where such sensors are not required.

The foregoing specific embodiment has been provided to illustrate the structural and functional principles of the present invention and is not intended to be limiting. To the contrary, the present invention is intended to encompass all modifications, substitutions, and alterations within the spirit and scope of the appended claims. For example, although an operator which opens the door under motor power and closes it by spring force is disclosed in the present application, it is to be understood that the principles of the present invention may be applied to a door operator which opens the door under spring a force and closes it under motor power. Other such variations on the features and arrangements disclosed herein will be readily understood by those in the art and are encompassed within the scope of the appended claims.

What is claimed:

1. A swing door operator for controlling pivoting movements of a door panel that is to be pivoted about a generally vertical door panel axis from a closed position in a power driven door opening direction and from the closed position in a manually driven breakout door opening direction opposite the power driven door opening direction, said swing door operator comprising:

an operator output member rotatable about an output member axis, said operator output member being constructed and arranged to be operatively connected with the door panel such that rotation of said output member about said output member axis pivots the door panel about the door panel axis thereof;

a motor operatively connected to said operator output member, said motor being constructed and arranged to rotate said output member about said output member axis in a first rotational direction to enable said operator output member to pivot the door panel in the power driven door opening direction from the closed position thereof when said output member is operatively connected to the door panel;

a driving member connected to said output member such that applying force to said driving member rotates said output member about said output member axis, said driver member comprising an offset member spaced radially from said output member axis such that (a) said offset member moves generally circumferentially with respect to said output member axis in a first circumferential direction as said output member rotates about said output member axis in said first rotational direction and (b) said offset member moves generally circumferentially with respect to said output member axis in a second circumferential direction opposite said first circumferential direction as said output member rotates about said output member axis in a second rotational direction opposite said first rotational direction;

a door return compression spring structure positioned in force applying relation with respect to said offset member such that operation of said motor to rotate said output member in said first rotational direction thereof and pivot the door panel when operatively connected thereto in the power driven door opening direction moves said offset member in said first circumferential direction thereof so as to stress said compression spring structure, said compression spring structure being constructed and arranged to thereafter apply a first spring return force to said offset member that tends to move said offset member in said second circumferential direction thereof so as to rotate said output member in the second rotational direction thereof and pivot the door panel when operatively connected thereto opposite the power driven door opening direction towards and into the closed position;

said door return compression spring structure being positioned in said force applying relation with respect to said offset member such that, when said operator output member is operatively connected to the door panel, manual pivoting movement of the door panel from the closed position thereof in the manually driven breakout door opening direction thereof rotates said output member in said second rotational direction thereof and moves said offset member in said second circumferential direction thereof so as to stress said compression spring structure, said compression spring structure being constructed and arranged to thereafter apply a second spring return force to said offset member that tends to rotate said output member in said first rotational direction thereof and pivot the door panel when operatively connected thereto opposite the breakout door opening direction towards and into the closed position.

2. A swing door operator according to claim 1, wherein operation of said motor to rotate said output member in said first rotational direction thereof moves said offset member in said first circumferential direction thereof so as to compress said spring structure and thereafter said spring structure resiliently extends so as to apply said first spring return force to said offset member; and wherein, when said operator output member is operatively connected to the door panel, pivoting movement of the door panel from the closed position thereof in the breakout door opening direction thereof rotates said output member in said second rotational direction thereof and moves said offset member in said second circumferential direction thereof so as to compress said spring structure and thereafter said spring structure resiliently extends so as to apply said second spring return force to said offset member.

3. A swing door operator according to claim 2, further comprising an input member rotatable about an input member axis extending radially with respect to said output member axis, said input member being coupled to said motor such that operation of said motor rotates said input member, said input member being coupled to said output member such that rotation of said input member about said input member axis rotates said output member about said output member axis.

4. A swing door operator according to claim 3, wherein said spring structure includes only one compression spring.

5. A swing door operator according to claim 4, wherein said driver member is fixed directly to said output member.

6. A swing door operator according to claim 5, wherein said driver member is generally circular.

7. A swing door operator according to claim 6, further comprising a cam structure engaging said offset member of said driver member in a camming relationship, said spring being engaged with said cam structure.

8. A swing door operator according to claim 6, wherein said motor has a motor output member and said motor is constructed and arranged to rotate said motor output member, said swing door operator further comprising a reduction transmission connected between said motor output member and said input member such that said transmission rotates said input member at a lower rotational speed than a rotational speed at which motor rotates said motor output member and at a higher torque than a torque at which said motor rotates said motor output member.

9. A swing door operator according to claim 8, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

10. A swing door operator according to claim 4, wherein said spring is mounted in an encircling relation about an exterior of said motor.

11. A swing door operator according to claim 4, wherein said motor has a rotatable motor output member that rotates during operation of said motor and wherein said swing door operator further comprises a reduction transmission connected between said motor output member and said input member such that said transmission rotates said input member at a lower rotational speed than the rotational speed at which said motor rotates said motor output member and at a higher torque than a torque at which said motor rotates said motor output member;

said spring being mounted in encircling relation about both an exterior of said motor and an exterior of said reduction transmission.

12. A swing door operator according to claim 11, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

13. A swing door operator according to claim 1, further comprising an input member rotatable about an input axis that extends at an angle with respect to said output member axis, said input member being coupled to said motor such that operation of said motor rotates said input member about said input member axis;

said operator output member having a set of gear teeth operatively associated therewith and wherein said input member having a set of gear teeth operatively associated therewith, said sets of gear teeth being intermeshed such that rotation of said input member about said input member axis rotates said output member about said output member axis;

said motor being constructed and arranged to rotate said input member about said input member axis such that, when said output member is operatively connected to the door panel, said input member rotates said output member in the first rotating direction thereof via said intermeshed sets of gear teeth so as to pivot the door panel in the power driven door opening direction, said compression spring structure being constructed and arranged to thereafter apply the aforesaid first spring return force that tends to move said offset member in said second circumferential direction thereof so as to rotate said output member in the second rotational direction thereof without transmission of said first spring return force from said input member to said output member via said intermeshed sets of gear teeth.

14. A swing door operator according to claim 13, wherein operation of said motor to rotate said output member in said first rotational direction thereof moves said offset member in said first circumferential direction thereof so as to compress said spring structure and thereafter said spring structure resiliently extends so as to apply said first spring return force to said offset member; and wherein, when said output member is operatively connected to the door panel, pivoting movement of the door panel from the closed position thereof in the breakout door opening direction thereof rotates said output member in said second rotational direction thereof and moves said offset member in said second circumferential direction thereof so as to compress said spring structure and thereafter said spring structure resiliently extends so as to apply said second spring return force to said offset member.

15. A swing door operator according to claim 14, wherein said input member axis extends radially with respect to said output member axis.

16. A swing door operator according to claim 15, wherein said spring structure includes only one compression spring.

17. A swing door operator according to claim 16, wherein said set of gear teeth operatively associated with said output member are provided on said driver member.

18. A swing door operator according to claim 17, wherein said input member carries a bevel gear providing said set of gear teeth operatively associated with said input member.

19. A swing door operator according to claim 18, wherein said driver member is fixed directly to said output member.

20. A swing door operator according to claim 19, wherein said driver member is generally circular.

21. A swing door operator according to claim 16, further comprising a cam structure engaging said offset member of said driver member in a camming relationship, said spring being engaged with said cam structure.

22. A swing door operator according to claim 16, wherein said motor has a motor output member and said motor is constructed and arranged to rotate said motor output member, said swing door operator further comprising a reduction transmission connected between said motor output member and said input member such that said transmission rotates said input member at a lower rotational speed than a rotational speed at which motor rotates said motor output member and at a higher torque than a torque at which said motor rotates said motor output member.

23. A swing door operator according to claim 22, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

24. An swing door operator according to claim 16, wherein said spring is mounted in an encircling relation about an exterior of said motor.

25. A swing door operator according to claim 16 wherein said motor has a rotatable motor output member that rotates during operation of said motor and wherein said swing door operator further comprises a reduction transmission connected between said motor output member and said input member such that (a) said transmission rotates said input member at a lower rotational speed than the rotational speed at which said motor rotates said motor output member and at a higher torque than a torque at which said motor rotates said motor output member.

26. A swing door operator according to claim 25, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

27. A swing door operator for controlling pivoting movements of a door panel that is to be pivoted about a generally vertical door panel axis from a closed position in a power driven door opening direction and from the closed position in a manually driven breakout door opening direction opposite the power driven door opening direction, said swing door operator comprising:

an operator output member rotatable about an output member axis, said operator output member being constructed and arranged to be operatively connected with the door panel such that rotation of said output member about said output member axis pivots the door panel about the door panel axis thereof;

a motor operatively connected to said operator output member, said motor being constructed and arranged to rotate said output member about said output member axis in a first rotational direction to enable said operator output member to pivot the door panel in the power driven door opening direction from the closed position thereof when said output member is operatively connected to the door panel;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in said first rotational direction thereof and pivot the door panel when operatively connected thereto in the power driven door opening direction causes said driving member to cam said cam surface so as to move said cam structure to stress said compression spring structure, said compression spring structure being constructed and arranged to thereafter apply a first spring return force to said cam structure that tends to cause said cam surface to cam said driving member so as to rotate said output member in a second rotational direction thereof and pivot the door panel when operatively connected thereto opposite the power driven door opening direction towards and into the closed position;

said cam structure and said driving member being constructed and arranged such that, when said operator output member is operatively connected to the door panel, manual pivoting movement of the door panel from the closed position thereof in the manually driven breakout door opening direction thereof rotates said output member in said second rotational direction thereof and causes said driving member to cam said cam surface so as to move said cam structure to stress said compression spring structure, said compression spring structure being constructed and arranged to thereafter apply a second spring return force to said cam structure that tends to cause said cam surface to cam said driving member so as to rotate said output member in said first rotational direction thereof and pivot the door panel when operatively connected thereto opposite the breakout door opening direction towards and into the closed position.

28. A swing door operator according to claim 27, further comprising an input member rotatable about an input member axis extending radially with respect to said output member axis, said input member being coupled to said motor such that operation of said motor rotates said input member, said input member being coupled to said output member such that rotation of said input member about said input member axis rotates said output member about said output member axis.

29. A swing door operator according to claim 28, wherein said spring structure includes only one compression spring.

30. A swing door operator according to claim 29, wherein said driver member is fixed directly to said output member.

31. A swing door operator according to claim 30, wherein said motor has a motor output member and said motor is constructed and arranged to rotate said motor output member, said swing door operator further comprising a reduction transmission connected between said motor output member and said input member such that said transmission rotates said input member at a lower rotational speed than a rotational speed at which motor rotates said motor output member and at a higher torque than a torque at which said motor rotates said motor output member.

32. A swing door operator according to claim 31, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

33. An automatic swing door assembly for installation in a wall of a building having an opening formed therethrough, said assembly comprising:

a frame assembly constructed and arranged to be mounted at the opening of said wall;

a door panel pivotally mounted to said frame assembly for pivotal movement about a generally vertically extending door panel axis from a closed position obstructing travel through the opening of said wall in a power driven door opening direction to a normal open position permitting travel through the opening of said wall and from said closed position in a manually driven breakout door opening direction opposite the power driven door opening direction to a breakout open position permitting travel through the opening of said wall;

a swing door operator comprising:

an operator output member rotatable about an output member axis, said operator output member being operatively connected with the door panel such that rotation of said output member about said output member axis pivots the door panel about the door panel axis thereof, a motor constructed and arranged to rotate said output member about said output member axis in a first rotational direction so as to pivot the door panel in the power driven door opening direction from the closed position thereof, a driving member connected to said output member such that applying force to said driving member rotates said output member about said output member axis, said driver member comprising an offset member spaced radially from said output member axis such that (a) said offset member moves generally circumferentially with respect to said output member axis in a first circumferential direction as said output member rotates about said output member axis in said first rotational direction and (b) said offset member moves generally circumferentially with respect to said output member axis in a second circumferential direction opposite said first circumferential direction as said output member rotates about said output member axis in a second rotational direction opposite said first rotational direction;

a door return compression spring structure positioned in force applying relation with respect to said offset member such that operation of said motor to rotate said output member in said first rotational direction thereof and pivot the door in the power driven door opening direction moves said offset member in said first circumferential direction thereof so as to stress said compression spring structure, said compression spring structure being constructed and arranged to thereafter apply a first spring return force to said offset member that tends to move said offset member in said second circumferential direction thereof so as to rotate said output member in the second rotational direction thereof and pivot the door panel operatively connected thereto opposite the power driven door opening direction towards and into the closed position;

said door return compression spring structure being positioned in said force applying relation with respect to said offset member such that manual pivoting movement of the door panel from the closed position thereof in the manually driven breakout door opening direction thereof rotates said output member in said second rotational direction thereof and moves said offset member in said second circumferential direction thereof so as to stress said compression spring structure, said compression spring structure being constructed and arranged to thereafter apply a second spring return force to said offset member that tends to rotate said output member in said first rotational direction thereof and pivot the door panel operatively connected thereto opposite the breakout door opening direction towards and into the closed position;

an input device operable to transmit a door opening signal in response to detecting a presence of an object adjacent said door assembly; and a controller communicated to said input device, said controller being operable to receive said door opening signal from said input device and to responsively control operation of said motor so as to cause said door operator to pivot said door panel in said first door opening direction thereof.

34. An automatic door assembly according to claim 33, wherein operation of said motor to rotate said output member in said first rotational direction thereof moves said offset member in said first circumferential direction thereof so as to compress said spring structure and thereafter said spring structure resiliently extends so as to apply said first spring return force to said offset member; and wherein pivoting movement of the door panel from the closed position thereof in the breakout door opening direction thereof rotates said output member in said second rotational direction thereof and moves said offset member in said second circumferential direction thereof so as to compress said spring structure and thereafter said spring structure resiliently extends so as to apply said second spring return force to said offset member.

35. An automatic door assembly according to claim 34, further comprising an input member rotatable about an input member axis extending radially with respect to said output member axis, said input member being coupled to said motor such that operation of said motor rotates said input member, said input member being coupled to said output member such that rotation of said input member about said input member axis rotates said output member about said output member axis.

36. An automatic door assembly according to claim 35, wherein said spring structure includes only one compression spring.

37. An automatic door assembly according to claim 36, wherein said swing door operator further comprises a cam structure engaging said offset member of said driver member in a camming relationship, said spring being engaged with said cam structure.

38. An automatic door assembly according to claim 34, wherein said motor has a motor output member and said motor is constructed and arranged to rotate said motor output member, said swing door operator further comprising a reduction transmission connected between said motor output member and said input member such that said transmission rotates said input member at a lower rotational speed than a rotational speed at which motor rotates said motor output member and at a higher torque than a torque at which said motor rotates said motor output member.

39. An automatic door assembly according to claim 38, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

40. An automatic door assembly according to claim 39, further comprising an input member rotatable about an input axis that extends to an angle with respect to said output member axis, said input member being coupled to said motor such that operation of said motor rotates said input member about said input member axis;

said operator output member having a set of gear teeth operatively associated therewith and wherein said input member having a set of gear teeth operatively associated therewith, said sets of gear teeth being intermeshed such that rotation of said input member about said input member axis rotates said output member about said output member axis;

said motor being constructed and arranged to rotate said input member about said input member axis such that said input member rotates said output member in the first rotating direction thereof via said intermeshed sets of gear teeth so as to pivot the door panel in the power driven door opening direction, said compression spring structure being constructed and arranged to thereafter apply the aforesaid first spring return force that tends to move said offset member in said second circumferential direction thereof so as to rotate said output member in the second rotational direction thereof without transmission of said first spring return force from said input member to said output member via said intermeshed sets of gear teeth.

41. An automatic door assembly according to claim 40, wherein operation of said motor to rotate said output member in said first rotational direction thereof moves said offset member in said first circumferential direction thereof so as to compress said spring structure and thereafter said spring structure resiliently extends so as to apply said first spring return force to said offset member; and wherein pivoting movement of the door panel from the closed position thereof in the breakout door opening direction thereof rotates said output member in said second rotational direction thereof and moves said offset member in said second circumferential direction thereof so as to compress said spring structure and thereafter said spring structure resiliently extends so as to apply said second spring return force to said offset member.

42. An automatic door assembly according to claim 41, wherein said set of gear teeth operatively associated with said output member are provided on said driver member.

43. An automatic door assembly according to claim 42, wherein said input member carries a bevel gear providing said set of gear teeth operatively associated with said input member.

44. An automatic swing door assembly for installation in a wall of a building having an opening formed therethrough, said assembly comprising:

a frame assembly constructed and arranged to be mounted at the opening of said wall;

a door panel pivotally mounted to said frame assembly for pivotal movement about a generally vertically extending door panel axis from a closed position obstructing travel through the opening of said wall in a power driven door opening direction to a normal open position permitting travel through the opening of said wall and from said closed position in a manually driven breakout door opening direction opposite the power driven door opening direction to a breakout open position permitting travel through the opening of said wall;

a swing door operator comprising:

an operator output member rotatable about an output member axis, said operator output member being operatively connected with the door panel such that rotation of said output member about said output member axis pivots the door panel about the door panel axis thereof;

a motor constructed and arranged to rotate said output member about said output member axis in a first rotating direction such that said operator output member pivots the door panel in the power driven door opening direction from the closed position thereof;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in said first rotational direction thereof and pivot the door in the power driven door opening direction causes said driving member to cam said cam structure so as to move said cam structure to stress said compression spring structure, said compression spring structure being constructed and arranged to thereafter apply a first spring return force to said cam structure that tends to cause said cam surface to cam said driving member so as to rotate said output member in the second rotational direction thereof and pivot the door panel operatively connected thereto opposite the power driven door opening direction towards and into the closed position;

said cam structure and said driving member being constructed and arranged such that manual pivoting movement of the door panel from the closed position thereof in the manually driven breakout door opening direction thereof rotates said output member in said second rotational direction thereof and causes said driving member to cam said cam surface so as to move said cam structure to stress said compression spring structure, said compression spring structure being constructed and arranged to thereafter apply a second spring return force to said cam structure that tends to cause said cam surface to cam said driving member so as to rotate said output member in said first rotational direction thereof and pivot the door panel operatively connected thereto opposite the breakout door opening direction towards and into the closed position;

an input device operable to transmit a door opening signal in response to detecting a presence of an object adjacent said door assembly; and a controller communicated to said input device, said controller being operable to receive said door opening signal from said input device and to responsively control operation of said motor so as to cause said door operator to pivot said door panel in said first door opening direction thereof.

45. An automatic door assembly according to claim 44, wherein said operator further comprises an input member rotatable about an input member axis extending radially with respect to said output member axis, said input member being coupled to said motor such that operation of said motor rotates said input member, said input member being coupled to said output member such that rotation of said input member about said input member axis rotates said output member about said output member axis.

46. An automatic door assembly according to claim 45, wherein said spring structure includes only one compression spring.

47. An automatic door assembly according to claim 46, wherein said driver member is fixed directly to said output member.

48. An automatic door assembly according to claim 44, wherein said motor has a motor output member and said motor is constructed and arranged to rotate said motor output member, said swing door operator further comprising a reduction transmission connected between said motor output member and said input member such that said transmission rotates said input member at a lower rotational speed than a rotational speed at which motor rotates said motor output member and at a higher torque than a torque at which said motor rotates said motor output member.

49. An automatic door assembly according to claim 48, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that rotation of said motor output member rotates said planet gear about said planet gear axis;

said planet gear being engaged with an interior surface of said orbit gear which faces generally radially inwardly with respect to said transmission axis such that rotation of said planet gear causes said planet gear to roll along said interior surface of said orbit gear generally circumferentially with respect to said transmission axis to rotate said gear carrier about said transmission axis;

said planet gear carrier being operatively connected to input member such that rotation of said planet gear carrier as a result of said planet gear being rotated by said motor output member rotates said input member to effect rotation of said operator output member about the output member axis.

50. A non-handed swing door operator for controlling pivoting movements of a door panel that pivots about a generally vertical door axis from a closed position to an open position, said swing door operator comprising:

an operator output member rotatable in first and second operator rotational directions about an operator output member axis, said operator output member being constructed and arranged to be operatively connected with the door panel such that rotation of said output member pivots the door panel about the door panel axis thereof;

a reversible motor coupled to said operator output member, said motor being constructed and arranged to rotate said operator output member in a selected one of said first and second operator rotational directions;

a driving member connected to said output member such that applying force to said driving member rotates said output member about said output member axis, said driving member comprising an offset member spaced radially from said output member axis such that (a) said offset member moves generally circumferentially with respect to said output member axis in a first circumferential direction as said output member rotates about said output member axis in said first operator rotational direction and (b) said offset member moves generally circumferentially with respect to said output member axis in a second circumferential direction opposite said first circumferential direction as said output member rotates about said output member axis in said second operator rotational direction;

a door return compression spring structure positioned in force applying relation with respect to said offset member such that operation of said motor to rotate said output member in said first operator rotational direction thereof moves said offset member in said first circumferential direction thereof so as to stress said spring structure, said spring structure being constructed and arranged to thereafter apply a first spring return force to said offset member that tends to move said offset member in said second circumferential direction thereof to rotate said operator output member in the second operator rotational direction thereof;

said door return compression spring structure being positioned in said force applying relation with respect to said offset member such that operation of said motor to rotate said output member in said second operator rotational direction thereof moves said offset member in said second circumferential direction thereof so as to stress said spring structure, said spring structure being constructed and arranged to thereafter apply a second spring return force to said offset member that tends to move said offset member in said first circumferential direction thereof to rotate said operator output member in the first operator rotational direction thereof.

51. A non-handed swing door operator according to claim 50, wherein said motor has a rotatable motor output member that rotates during operation of said motor and further comprising an input member coupled to said motor output member, said input member being rotatable about an input member axis extending at an angle with respect to said operator output member axis under rotation of said motor output member, said input member being coupled with said operator output member such that rotation of said input member about said input member axis rotates said operator output member about said operator output member axis.

52. A non-handed swing door operator according to claim 51, wherein said input member axis extends radially with respect to said output member axis.

53. A non-handed swing door operator according to claim 52, further comprising a reduction transmission connected between said motor output member and said input member such that (a) said transmission rotates said input member to effect rotation of said operator output member in said first operator rotational direction at a lower rotational speed than the rotational speed at which said motor rotates said motor output member in said first motor rotational direction and at a higher torque than a torque at which said motor rotates said motor output member in said first motor rotational direction and (b) said transmission rotates said input member to effect rotation of said operator output member in said second operator rotational direction at a lower rotational speed than a rotational speed at which said motor rotates said motor output member in said second motor rotational direction and at a higher torque than a torque at which said motor rotates said motor output member in said second motor rotational direction.

54. A non-handed swing door operator according to claim 53, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that (a) rotation of said motor output member in the first motor rotational direction thereof rotates said planet gear in a first planet gear rotating direction about said planet gear axis and (b) rotation of said motor output member in the second motor rotational direction thereof rotates said planet gear in a second planet gear rotating direction about said planet gear axis opposite said first planet gear rotating direction;

said planet gear being engaged with an interior surface of said orbit gear which faces generally radially inwardly with respect to said transmission axis such that (a) rotation of said planet gear in said first planet gear rotating direction causes said planet gear to roll along said interior surface of said orbit gear generally circumferentially with respect to said transmission axis to rotate said gear carrier in a first carrier rotating direction about said transmission axis and (b) rotation of said planet gear in said second planet gear rotating direction causes said planet gear to roll along said interior surface of said orbit gear generally circumferentially with respect to said transmission axis to rotate said gear carrier in a second carrier rotating direction about said transmission axis opposite said first carrier rotating direction;

said planet gear carrier being operatively connected to input member such that (a) rotation of said planet gear carrier in said first carrier rotating direction thereof as a result of said planet gear being rotated in said first planet rotating direction thereof by said motor output member rotates said input member to effect rotation of said operator output member in the first operator rotational direction and (b) rotation of said planet gear carrier in said second carrier rotating direction thereof as a result of said planet gear being rotated in said first planet rotating direction thereof by said motor output member rotates said input member to effect rotation of said operator output member in the second operator rotational direction thereof.

55. A non-handed swing door operator according to claim 54, wherein said reversible motor is a reversible electric motor.

56. A non-handed swing door operator according to claim 55, wherein operation of said motor to rotate said motor output member in said first motor rotational direction thereof and thus said operator output member in said first operator rotational direction thereof moves said offset member in said first circumferential direction so as to compress said spring structure and thereafter said spring structure resiliently extends so as to apply said first spring return force to said offset member; and wherein operation of said motor to rotate said motor output member in said second motor rotational direction thereof and thus said operator output member in said second operator rotational direction thereof moves said offset member in said second circumferential direction thereof so as to compress said spring structure and thereafter said spring structure resiliently extends so as to apply said second spring return force to said offset member.

57. A non-handed swing door operator according to claim 56, wherein said spring structure includes only one compression spring.

58. A non-handed swing door operator according to claim 57, wherein said driver member is fixed directly to said output member.

59. A non-handed swing door operator according to claim 58, wherein said driver member is generally circular.

60. A non-handed swing door operator according to claim 57, further comprising a camming member engaging said offset member of said driver member in a camming relationship, said spring being engaged with said camming member.

61. A non-handed swing door operator according to claim 50, wherein when said operator output member is operatively connected to a door panel that is to be pivoted about a generally vertical door panel axis from a closed position in a power driven door opening direction and in a manually driven breakout door opening direction opposite the power driven door opening direction in such a manner that rotation of said operator output member in said first operator rotational direction thereof pivots the door panel in the power driven door opening direction thereof (a) operation of said motor to rotate said operator output member in said first operator rotational direction thereof so as to pivot the door in the power driven door opening direction moves said offset member in said first circumferential direction thereof so as to stress said compression spring structure and said compression spring structure thereafter applies said first spring return force to said offset member that tends to rotate said output member in the second operator rotational direction thereof and pivot the door panel operatively connected thereto opposite the power driven door opening direction towards and into the closed position, and (b) manual pivoting movement of the door panel from the closed position thereof in the breakout door opening direction thereof rotates said output member in said second operator rotational direction thereof and moves said offset member in said second circumferential direction thereof so as to stress said compression spring structure and said compression spring structure thereafter applies said second spring return force to said offset member that tends to rotate said output member in said first operator rotational direction thereof and pivot the door panel operatively connected thereto opposite the breakout door opening direction towards and into the closed position.

62. A non-handed swing door operator according to claim 61, wherein said motor has a rotatable motor output member that rotates during operation of said motor and further comprising an input member rotatable about an input member axis extending at an angle with respect to said operator output member axis, said input member being coupled with said operator output member such that rotation of said input member about said input member axis rotates said operator output member about said operator output member axis.

63. A non-handed swing door operator according to claim 62, wherein said input member axis extends radially with respect to said operator output member axis.

64. A non-handed swing door operator according to claim 63, further comprising a reduction transmission connected between said motor output member and said input member such that (a) said transmission rotates said input member to effect rotation of said operator output member in said first operator rotational direction at a lower rotational speed than the rotational speed at which said motor rotates said motor output member in said first motor rotational direction and at a higher torque than a torque at which said motor rotates said motor output member in said first motor rotational direction and (b) said transmission rotates said input member to effect rotation of said operator output member in said second operator rotational direction at a lower rotational speed than a rotational speed at which said motor rotates said motor output member in said second motor rotational direction and at a higher torque than a torque at which said motor rotates said motor output member in said second motor rotational direction.

65. A non-handed swing door operator according to claim 64, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that (a) rotation of said motor output member in the first motor rotational direction thereof rotates said planet gear in a first planet gear rotating direction about said planet gear axis and (b) rotation of said motor output member in the second motor rotational direction thereof rotates said planet gear in a second planet gear rotating direction about said planet gear axis opposite said first planet gear rotating direction;

said planet gear being engaged with an interior surface of said orbit gear which faces generally radially inwardly with respect to said transmission axis such that (a) rotation of said planet gear in said first planet gear rotating direction causes said planet gear to roll along said interior surface of said orbit gear generally circumferentially with respect to said transmission axis to rotate said gear carrier in a first carrier rotating direction about said transmission axis and (b) rotation of said planet gear in said second planet gear rotating direction causes said planet gear to roll along said interior surface of said orbit gear generally circumferentially with respect to said transmission axis to rotate said gear carrier in a second carrier rotating direction about said transmission axis opposite said first carrier rotating direction;

said planet gear carrier being operatively connected to input member such that (a) rotation of said planet gear carrier in said first carrier rotating direction thereof as a result of said planet gear being rotated in said first planet rotating direction thereof by said motor output member rotates said input member to effect rotation of said operator output member in the first operator rotational direction and (b) rotation of said planet gear carrier in said second carrier rotating direction thereof as a result of said planet gear being rotated in said first planet rotating direction thereof by said motor output member rotates said input member to effect rotation of said operator output member in the second operator rotational direction thereof.

66. A non-handed swing door operator according to claim 65, wherein said reversible motor is a reversible electric motor.

67. A non-handed swing door operator according to claim 66, wherein operation of said motor to rotate said motor output member in said first motor rotational direction thereof and thus said output member in said first operator rotational direction thereof moves said offset member in said first circumferential direction thereof so as to compress said spring structure and thereafter said spring structure resiliently extends so as to apply said first spring return force to said driver member; and wherein operation of said motor to rotate said motor output member in said second motor rotational direction thereof and thus said output member in said second operator rotational direction thereof moves said offset member in said second circumferential direction thereof so as to compress said spring structure and thereafter said spring structure resiliently extends so as to apply said second spring return force to said driver member.

68. A non-handed swing door operator according to claim 67, wherein said spring structure includes only one compression spring.

69. A non-handed swing door operator according to claim 68, wherein said driver member is fixed directly to said output member.

70. A non-handed swing door operator according to claim 68, wherein said driver member is generally circular.

71. A non-handed swing door operator according to claim 55, wherein said operator output member has a set of gear teeth operatively associated therewith and wherein said input member has a set of gear teeth operatively associated therewith, said sets of gear teeth being intermeshed such that rotation of said input member about said input member axis rotates said output member about said output member axis;

said motor being constructed and arranged to rotate said input member about said input member axis such that, when said output member is operatively connected to the door panel, said input member rotates said output member in the first operator rotational direction thereof via said intermeshed sets of gear teeth, said compression spring structure being constructed and arranged to thereafter apply the aforesaid first spring return force that tends to move said offset member in said second circumferential direction so as to rotate said output member in the second operator rotational direction thereof without transmission of said first spring return force from said input member to said output member via said intermeshed sets of gear teeth;

said motor being constructed and arranged to rotate said input member about said input member axis such that, when said output member is operatively connected to the door panel, said input member rotates said output member in the second operator rotational direction thereof via said intermeshed sets of gear teeth, said compression spring structure being constructed and arranged to thereafter apply the aforesaid second spring return force that tends to move said offset member in said first circumferential direction thereof so as to rotate said output member in the first rotational direction thereof without transmission of said second spring return force from said input member to said output member via said intermeshed sets of gear teeth.

72. A non-handed swing door operator according to claim 71, wherein said input member axis extends radially with respect to said output member axis.

73. A non-handed swing door operator according to claim 71, wherein said spring structure includes only one compression spring.

74. A non-handed swing door operator according to claim 73, wherein said set of gear teeth operatively associated with said output member are provided on said driver member.

75. A non-handed swing door operator according to claim 74, wherein said input member carries a bevel gear providing said set of gear teeth operatively associated with said input member.

76. A non-handed swing door operator according to claim 75, wherein said driver member is fixed directly to said output member.

77. A non-handed swing door operator according to claim 76, wherein said driver member is generally circular.

78. A non-handed swing door operator for controlling pivoting movements of a door panel that pivots about a generally vertical door axis from a closed position to an open position, said swing door operator comprising:

an operator output member rotatable in first and second operator rotational directions about an operator output member axis, said operator output member being constructed and arranged to be operatively connected with the door panel such that rotation of said output member pivots the door panel about the door panel axis thereof;

a reversible motor coupled to said operator output member, said motor being constructed and arranged to rotate said operator output member in a selected one of said first and second operator rotational directions;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in said first operator rotational direction thereof causes said driving member to cam said cam surface so as to move said cam structure to stress said spring structure, said spring structure being constructed and arranged to thereafter apply a first spring return force to said cam structure that tends to cause said cam surface to cam said driver member so as to rotate said operator output member in the second operator rotational direction thereof;

said cam structure and said driving member being constructed and arranged such that operation of said motor to rotate said output member in said second operator rotational direction thereof causes said driving member to cam said cam surface so as to move said cam structure to stress said spring structure, said spring structure being constructed and arranged to thereafter apply a second spring return force to said cam structure that tends to cause said cam surface to cam said driving member so as to rotate said operator output member in the first operator rotational direction thereof.

79. A non-handed swing door operator according to claim 78, wherein said motor has a rotatable motor output member that rotates during operation of said motor and further comprising an input member coupled to said motor output member, said input member being rotatable about an input member axis extending at an angle with respect to said operator output member axis under rotation of said motor output member, said input member being coupled with said operator output member such that rotation of said input member about said input member axis rotates said operator output member about said operator output member axis.

80. A non-handed swing door operator according to claim 79, wherein said input member axis extends radially with respect to said output member axis.

81. A non-handed swing door operator according to claim 80, further comprising a reduction transmission connected between said motor output member and said input member such that (a) said transmission rotates said input member to effect rotation of said operator output member in said first operator rotational direction at a lower rotational speed than the rotational speed at which said motor rotates said motor output member in said first motor rotational direction and at a higher torque than a torque at which said motor rotates said motor output member in said first motor rotational direction and (b) said transmission rotates said input member to effect rotation of said operator output member in said second operator rotational direction at a lower rotational speed than a rotational speed at which said motor rotates said motor output member in said second motor rotational direction and at a higher torque than a torque at which said motor rotates said motor output member in said second motor rotational direction.

82. A non-handed swing door operator according to claim 81, wherein said reduction transmission comprises (a) an orbit gear arranged generally coaxially with respect to a transmission axis, (b) a planetary gear carrier positioned radially inwardly of said orbit gear for rotation about said transmission axis and having a planetary gear mounting portion offset generally radially from said transmission axis, and (c) a planetary gear rotatably mounted to said mounting portion of said gear carrier such that said planet gear rotates relative to said gear carrier about a planet gear axis which is offset generally radially from said transmission axis;

said planet gear being operatively connected to said motor output member such that (a) rotation of said motor output member in the first motor rotational direction thereof rotates said planet gear in a first planet gear rotating direction about said planet gear axis and (b) rotation of said motor output member in the second motor rotational direction thereof rotates said planet gear in a second planet gear rotating direction about said planet gear axis opposite said first planet gear rotating direction;

said planet gear being engaged with an interior surface of said orbit gear which faces generally radially inwardly with respect to said transmission axis such that (a) rotation of said planet gear in said first planet gear rotating direction causes said planet gear to roll along said interior surface of said orbit gear generally circumferentially with respect to said transmission axis to rotate said gear carrier in a first carrier rotating direction about said transmission axis and (b) rotation of said planet gear in said second planet gear rotating direction causes said planet gear to roll along said interior surface of said orbit gear generally circumferentially with respect to said transmission axis to rotate said gear carrier in a second carrier rotating direction about said transmission axis opposite said first carrier rotating direction;

said planet gear carrier being operatively connected to input member such that (a) rotation of said planet gear carrier in said first carrier rotating direction thereof as a result of said planet gear being rotated in said first planet rotating direction thereof by said motor output member rotates said input member to effect rotation of said operator output member in the first operator rotational direction and (b) rotation of said planet gear carrier in said second carrier rotating direction thereof as a result of said planet gear being rotated in said first planet rotating direction thereof by said motor output member rotates said input member to effect rotation of said operator output member in the second operator rotational direction thereof.

83. A non-handed swing door operator according to claim 82, wherein said reversible motor is a reversible electric motor.

84. A non-handed swing door operator according to claim 83, wherein said spring structure includes only one compression spring.

85. A non-handed swing door operator according to claim 84, wherein said driver member is fixed directly to said output member.

86. A swing door operator for controlling pivoting movements of a door panel that is to be pivoted about a generally vertical door panel axis from a closed position to an open position, said swing door operator comprising:

an operator output member rotatable about an output member axis, said operator output member being constructed and arranged to be operatively connected with the door panel such that rotation of said output member about said output member axis pivots the door panel about the door panel axis thereof;

a motor coupled to said operator output member, said motor being constructed and arranged to rotate said output member about said output member axis such that, when said output member is operatively connected to the door panel, said operator output member pivots the door panel about the door panel axis thereof;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that, when said operator output member is operatively connected to the door panel, operation of said motor to rotate said output member in a first rotational direction thereof and pivot the door in a first door panel pivoting direction about the door panel axis thereof causes said driving member to cam said cam surface so as to move said cam structure to stress said compression spring structure, said compression spring structure being constructed and arranged to thereafter apply a spring force to said cam structure that tends to cause said cam surface to cam said driving member so as to rotate said output member in a second rotational direction opposite said first rotational direction thereof and pivot the door panel when operatively connected thereto in a second door pivoting direction opposite said first door pivoting direction about the door panel axis thereof.

87. A swing door operator according to claim 86, wherein said cam structure and said driving member are constructed and arranged such that said spring structure tends to normally maintain said driving member in a position corresponding to the closed position of the door panel.

88. A swing door operator according to claim 86, wherein said driving member comprises an offset member spaced radially from said output member axis and wherein said cam structure moves generally radially with respect to said output member axis in a cam travelling direction such that (a) said offset member moves generally circumferentially with respect to said output member axis in a first circumferential direction as said output member rotates about said output member axis in said first rotational direction so as to cam said cam structure in generally radially with respect to said output member axis and (b) said offset member moves generally circumferentially with respect to said output member axis in a second circumferential direction opposite said first circumferential direction as said output member rotates about said output member axis in a second rotational direction opposite said first rotational direction so as to cam said cam structure generally radially with respect to said output member axis.

89. A swing door operator according to claim 88, wherein when said operator output member is in a position corresponding to the closed position of said door panel, said offset member is disposed in alignment with said cam travelling direction, said cam surface having a portion extending at an angle with respect to said cam travelling direction such the spring force applied to said offset member as said offset member cams along said portion of said cam surface varies in a non-linear manner.

90. A swing door operator according to claim 89, wherein said cam surface is generally U-shaped and generally symmetrical with respect to said cam travelling direction.

91. A swing door operator according to claim 89, wherein said driver member has a force receiving member disposed concentrically with respect to said output member axis and wherein said cam structure provides a force transmitting surface, said force transmitting surface being engageable with said force receiving member such that forces transverse to said cam travelling direction applied to said cam structure as a result of said offset member camming along said portion of said cam surface are transmitted to said force receiving member.

92. A swing door operator according to claim 90, wherein said driver member has a force receiving member disposed concentrically with respect to said output member axis and wherein said cam structure provides a pair of force transmitting surfaces, said force transmitting surfaces being engageable with said force receiving member such that forces transverse to said cam travelling direction applied to said cam structure as a result of said offset member camming along said portion of said cam surface are transmitted to said force receiving member.

93. An automatic swing door assembly for installation in a wall of a building having an opening formed therethrough, said assembly comprising:

a frame assembly constructed and arranged to be mounted at the opening of said wall;

a door panel pivotally mounted to said frame assembly for pivotal movement about a generally vertically extending door panel axis from a closed position obstructing travel through the opening of said wall in a power driven door opening direction to a normal open position permitting travel through the opening of said wall and from said closed position in a manually driven breakout door opening direction opposite the power driven door opening direction to a breakout open position permitting travel through the opening of said wall;

a swing door operator comprising:

an operator output member rotatable about an output member axis, said operator output member being operatively connected with the door panel such that rotation of said output member about said output member axis pivots the door panel about the door panel axis thereof;

a motor coupled to said operator output member, said motor being constructed and arranged to rotate said output member about said output member axis such that said operator output member pivots the door panel about the door panel axis thereof;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in a first rotational direction thereof and pivot the door in a first door panel pivoting direction about the door panel axis thereof causes said driving member to cam said cam surface so as to move said cam structure to stress said compression spring structure, said compression spring structure being constructed and arranged to thereafter apply a spring force to said cam structure that tends to cause said cam surface to cam said driving member so as to rotate said output member in a second rotational direction opposite said first rotational direction thereof and pivot the door panel operatively connected thereto in a second door pivoting direction opposite said first door pivoting direction about the door panel axis thereof;

an input device operable to transmit a door opening signal in response to detecting a presence of an object adjacent said door assembly; and a controller communicated to said input device, said controller being operable to receive said door opening signal from said input device and to responsively control operation of said motor so as to cause said door operator to pivot said door panel in said first door opening direction thereof.

94. An automatic door assembly according to claim 93, wherein said cam structure and said driving member are constructed and arranged such that said spring structure tends to normally maintain said driving member in a position corresponding to the closed position of the door panel.

95. An automatic door assembly according to claim 94, wherein said driving member comprises an offset member spaced radially from said output member axis and wherein said cam structure moves generally radially with respect to said output member axis in a cam travelling direction such that (a) said offset member moves generally circumferentially with respect to said output member axis in a first circumferential direction as said output member rotates about said output member axis in said first rotational direction so as to cam said cam structure in generally radially with respect to said output member axis and (b) said offset member moves generally circumferentially with respect to said output member axis in a second circumferential direction opposite said first circumferential direction as said output member rotates about said output member axis in a second rotational direction opposite said first rotational direction so as to cam said cam structure generally radially with respect to said output member axis.

96. An automatic door assembly according to claim 95, wherein when said door panel is in the closed position thereof, said offset member is disposed in alignment with said cam travelling direction, said cam surface having a portion extending at an angle with respect to said cam travelling direction such the spring force applied to said offset member as said offset member cams along said portion of said cam surface varies in a non-linear manner.

97. An automatic door assembly according to claim 96, wherein said cam surface is generally U-shaped and generally symmetrical with respect to said cam travelling direction and wherein the portion of said U-shaped cam surface at which the legs thereof converge cooperates with said offset member such that said spring structure tends to normally maintain said driving member in the position corresponding to the closed position of the door panel.

98. An automatic door assembly according to claim 96, wherein said driver member has a force receiving member disposed concentrically with respect to said output member axis and wherein said cam structure provides a force transmitting surface, said force transmitting surface being engageable with said force receiving member such that forces transverse to said cam travelling direction applied to said cam structure as a result of said offset member camming along said portion of said cam surface are transmitted to said force receiving member.

99. An automatic door assembly according to claim 97, wherein said driver member has a force receiving member disposed concentrically with respect to said output member axis and wherein said cam structure provides a pair of force transmitting surfaces, said force transmitting surfaces being engageable with said force receiving member such that forces transverse to said cam travelling direction applied to said cam structure as a result of said offset member camming along said portion of said cam surface are transmitted to said force receiving member.

100. A swing door operator for controlling pivoting movements of a door panel that is to be pivoted about a generally vertical door panel axis between open and closed directions, said swing door operator comprising:

an operator output member rotatable about an output member axis, said operator output member being constructed and arranged to be operatively connected with the door panel such that rotation of said output member about said output member axis pivots the door panel about the door panel axis thereof, said operator output member having a set of gear teeth operatively associated therewith;

a rotatable input member having a set of gear teeth intermeshed with said set of gear teeth associated with said operator output member such that rotation of said input member rotates said output member about said output axis thereof;

a motor constructed and arranged to rotate said input member such that, when said output member is operatively connected to the door panel, said input member rotates said output member in a first rotational direction via said intermeshed sets of gear teeth so as to pivot the door panel in a first door pivoting direction about the door panel axis thereof;

a driving member connected to said output member such that applying force to said driving member rotates said output member about said output member axis, said driver member comprising an offset member spaced radially from said output member axis such that (a) said offset member moves generally circumferentially with respect to said output member axis in a first circumferential direction as said output member rotates about said output member axis in said first rotational direction and (b) said offset member moves generally circumferentially with respect to said output member axis in a second circumferential direction opposite said first circumferential direction as said output member rotates about said output member axis in a second rotational direction opposite said first rotational direction;

a door return compression spring structure positioned in force applying relation with respect to said offset member such that operation of said motor to rotate said output member in said first rotational direction thereof and pivot the door panel in the first door pivoting direction moves said offset member in said first circumferential direction thereof so as to stress said compression spring structure, said compression spring structure being constructed and arranged to thereafter apply a spring force to said offset member that tends to move said offset member in said second circumferential direction thereof so as to rotate said output member in the second rotational direction thereof and pivot the door panel operatively connected thereto in a second door pivoting direction opposite the first door pivoting direction without transmission of said spring force from said input member to said output member via said intermeshed sets of gear teeth.

101. A swing door operator according to claim 100, wherein said input member is rotatable about an input member axis that extends at an angle with respect to said output member axis.

102. A swing door operator according to claim 101, wherein said input member axis extends radially with respect to said output member axis.

103. A swing door operator for controlling pivoting movements of a door panel that is to be pivoted about a generally vertical door panel axis between open and closed directions, said swing door operator comprising:

an operator output member rotatable about an output member axis, said operator output member being constructed and arranged to be operatively connected with the door panel such that rotation of said output member about said output member axis pivots the door panel about the door panel axis thereof, said operator output member having a set of gear teeth operatively associated therewith;

a rotatable input member having a set of gear teeth intermeshed with said set of gear teeth associated with said operator output member such that rotation of said input member rotates said output member about said output axis thereof;

a motor constructed and arranged to rotate said input member such that, when said output member is operatively connected to the door panel, said input member rotates said output member in a first rotational direction via said intermeshed sets of gear teeth so as to pivot the door panel when operatively connected to said output member in a first door pivoting direction about the door panel axis thereof;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in said first rotational direction thereof and pivot the door panel when operatively connected to said output member in the first door pivoting direction thereof causes said driving member to cam said cam surface so as to move said cam structure to stress said compression spring structure, said compression spring structure being constructed and arranged to thereafter apply a spring force to said cam structure that tends to cause said cam surface to cam said driving member so as to rotate said output member in a second rotational direction thereof opposite said first rotational direction and pivot the door panel when operatively connected thereto in a second door pivoting direction opposite the first do pivoting direction.

104. An automatic swing door assembly for installation in a wall of a building having an opening formed therethrough, said assembly comprising:

a frame assembly constructed and arranged to be mounted at the opening of said wall;

a door panel pivotally mounted to said frame assembly for pivotal movement about a generally vertically extending door panel axis from a closed position obstructing travel through the opening of said wall to an open position permitting travel through the opening of said wall;

a swing door operator comprising:

an operator output member rotatable about an output member axis, said operator output member operatively connected with the door panel such that rotation of said output member about said output member axis pivots the door panel about the door panel axis thereof, said operator output member having a set of gear teeth operatively associated therewith;

a rotatable input member having a set of gear teeth intermeshed with said set of gear teeth associated with said operator output member such that rotation of said input member rotates said output member about said output axis thereof;

a motor constructed and arranged to rotate said input member such that said input member rotates said output member in a first rotational direction via said intermeshed sets of gear teeth so as to pivot the door panel in a first door pivoting direction about the door panel axis thereof;

a driving member connected to said output member such that applying force to said driving member rotates said output member about said output member axis, said driver member comprising an offset member spaced radially from said output member axis such that (a) said offset member moves generally circumferentially with respect to said output member axis in a first circumferential direction as said output member rotates about said output member axis in said first rotational direction and (b) said offset member moves generally circumferentially with respect to said output member axis in a second circumferential direction opposite said first circumferential direction as said output member rotates about said output member axis in a second rotational direction opposite said first rotational direction;

a door return compression spring structure positioned in force applying relation with respect to said offset member such that operation of said motor to rotate said output member in said first rotational direction thereof and pivot the door panel in the first door pivoting direction moves said offset member in said first circumferential direction thereof so as to stress said compression spring structure, said compression spring structure being constructed and arranged to thereafter apply a spring force to said offset member that tends to move said offset member in said second circumferential direction thereof so as to rotate said output member in the second rotational direction thereof and pivot the door panel operatively connected thereto in a second door pivoting direction opposite the first door pivoting direction without transmission of said spring force from said input member to said output member via said intermeshed sets of gear teeth;

an input device operable to transmit a door opening signal in response to detecting a presence of an object adjacent said door assembly; and a controller communicated to said input device, said controller being operable to receive said door opening signal from said input device and to responsively control operation of said motor to affect opening movement of the door panel.

105. An automatic swing door assembly for installation in a wall of a building having an opening formed therethrough, said assembly comprising:

a frame assembly constructed and arranged to be mounted at the opening of said wall;

a door panel pivotally mounted to said frame assembly for pivotal movement about a generally vertically extending door panel axis from a closed position obstructing travel through the opening of said wall to an open position permitting travel through the opening of said wall;

a swing door operator comprising:

an operator output member rotatable about an output member axis, said operator output member being operatively connected with the door panel such that rotation of said output member about said output member axis pivots the door panel about the door panel axis thereof, said operator output member having a set of gear teeth operatively associated therewith;

a rotatable input member having a set of gear teeth intermeshed with said set of gear teeth associated with said operator output member such that rotation of said input member rotates said output member about said output axis thereof;

a motor constructed and arranged to rotate said input member such that said input member rotates said output member in a first rotational direction via said intermeshed sets of gear teeth so as to pivot the door panel in a first door pivoting direction about the door panel axis thereof;

a driving member connected to said output member such that applying force to said driving member rotates said output member about said output member axis;

a cam structure having a cam surface engaged with said driving member in a camming relationship;

a door return compression spring structure positioned in force applying relation with respect to said cam structure, said cam structure and said driving member being constructed and arranged such that operation of said motor to rotate said output member in said first rotational direction thereof and pivot the door in the first door pivoting direction thereof causes said driving member to cam said cam surface so as to move said cam structure to stress said compression spring structure, said compression spring structure being constructed and arranged to thereafter apply a spring force to said cam structure that tends to cause said cam surface to cam said driving member so as to rotate said output member in a second rotational direction thereof opposite said first rotational direction and pivot the door panel operatively connected thereto in a second door pivoting direction opposite the first door pivoting direction;

an input device operable to transmit a door opening signal in response to detecting a presence of an object adjacent said door assembly; and a controller communicated to said input device, said controller being operable to receive said door opening signal from said input device and to responsively control operation of said motor to affect opening movement of the door panel.

* * * * *